US006591435B1

(12) United States Patent
Hodgetts

(10) Patent No.: US 6,591,435 B1
(45) Date of Patent: Jul. 15, 2003

(54) PATIENT TRANSPORT SYSTEM

(76) Inventor: Graham L. Hodgetts, 212 Silverdale Dr., Baden, PA (US) 15005

( * ) Notice: Subject to any disclaimer, the term of this patent is extended or adjusted under 35 U.S.C. 154(b) by 0 days.

(21) Appl. No.: 09/787,829

(22) PCT Filed: Sep. 23, 1999

(86) PCT No.: PCT/US99/22094

§ 371 (c)(1),
(2), (4) Date: Mar. 22, 2001

(87) PCT Pub. No.: WO00/16727

PCT Pub. Date: Mar. 30, 2000

Related U.S. Application Data

(60) Provisional application No. 60/101,597, filed on Sep. 24, 1998.

(51) Int. Cl.[7] ..... A61G 7/14

(52) U.S. Cl. ..... 5/88.1; 5/81.1 HS

(58) Field of Search ..... 5/81.1 R, 81.1 HS, 5/81.1 C, 83.1, 88.1, 89.1

(56) References Cited

U.S. PATENT DOCUMENTS

| | | | | |
|---|---|---|---|---|
| 378,220 A | | 2/1888 | Staples et al. | |
| 716,886 A | | 12/1902 | Goode | |
| 1,263,611 A | | 4/1918 | Scroggin | |
| 1,487,171 A | | 3/1924 | La Vigne | |
| 2,093,231 A | | 3/1937 | Broadwell | 24/245 |
| 2,439,066 A | | 4/1948 | Vanderlyn | 5/88.1 |
| 2,487,648 A | | 11/1949 | Green | 248/267 |
| 2,536,707 A | | 1/1951 | Allyn | 5/85 |
| 2,630,583 A | | 3/1953 | Gilleland | 5/81 |
| 2,632,619 A | | 3/1953 | Wilson | 248/201 |
| 2,665,432 A | * | 1/1954 | Butler | 5/88.1 |
| 2,733,452 A | | 2/1956 | Tanney | 5/81 |
| 2,745,163 A | | 5/1956 | Buren, Jr. | 24/246 |
| 2,827,642 A | * | 3/1958 | Huff | 5/88.1 |
| 2,939,195 A | | 6/1960 | Carlson | 24/245 |
| 3,108,290 A | * | 10/1963 | Partridge | 5/88.1 |
| 3,140,069 A | | 7/1964 | McBurney et al. | 248/201 |
| 3,165,760 A | | 1/1965 | Abjian | |
| 3,294,247 A | | 12/1966 | Norrington | 248/201 |
| 3,302,219 A | | 2/1967 | Harris | 5/85 |
| 3,413,663 A | | 12/1968 | Swann | 5/81 |
| 3,593,351 A | | 7/1971 | Dove | 5/81 |
| 3,709,556 A | | 1/1973 | Allard et al. | 248/125 |
| 3,769,642 A | | 11/1973 | Warman | 5/81 |
| 3,775,784 A | | 12/1973 | Fry | 5/81 |
| 3,794,313 A | | 2/1974 | Berger et al. | 269/322 |
| 3,810,263 A | | 5/1974 | Taylor et al. | 5/81 |
| 3,848,784 A | | 11/1974 | Baxter | 211/60.1 |
| 3,848,786 A | | 11/1974 | Baxter | 248/73 |
| 3,924,281 A | | 12/1975 | Gibbs | 5/88.1 |
| 4,068,770 A | | 1/1978 | Boehringer | 214/85 |
| 4,270,234 A | | 6/1981 | James | 5/88.1 |
| 4,403,641 A | | 9/1983 | Reeder | 160/238 |
| 4,416,511 A | | 11/1983 | Weinberg | 160/238 |

(List continued on next page.)

FOREIGN PATENT DOCUMENTS

| | | |
|---|---|---|
| GB | 26017 | 11/1907 |
| GB | 10012 | 4/1909 |
| WO | 00221 | 1/1986 |

*Primary Examiner*—Michael F. Trettel
(74) *Attorney, Agent, or Firm*—Webb Ziesenheim Logsdon Orkin & Hanson, P.C.

(57) ABSTRACT

A patient transport system for transporting a patient from a bed to a stretcher or vice versa, using a bed sheet and a conveyor attached to the bed or the stretcher. A first end of the sheet is removably attached to the conveyor and a second end of the sheet is free. The sheet is adapted to be positioned onto the patient supporting member of the bed or stretcher. The conveyor includes a roller received by bearings. The roller can be removably received by the bearings. The roller can also include a telescopic arrangement so that its length can be adjusted.

19 Claims, 16 Drawing Sheets

U.S. PATENT DOCUMENTS

| | | | | | |
|---|---|---|---|---|---|
| 4,502,169 | A | | 3/1985 | Persson | 5/88.1 |
| 4,660,240 | A | | 4/1987 | Hutton et al. | 5/498 |
| 4,679,259 | A | | 7/1987 | DiMatteo et al. | 5/81.1 |
| 4,681,279 | A | | 7/1987 | Nakumura | 160/294 |
| 4,686,748 | A | | 8/1987 | Kaivanto | 24/522 |
| 4,688,304 | A | | 8/1987 | Marcott | 24/459 |
| 4,696,025 | A | | 9/1987 | Taylor | 378/146 |
| 4,747,170 | A | | 5/1988 | Knouse | 5/81 |
| 4,761,841 | A | | 8/1988 | Larsen | 5/81 |
| 4,776,047 | A | | 10/1988 | DiMatteo | 5/81 |
| 4,787,104 | A | | 11/1988 | Grantham | 5/66 |
| 4,837,873 | A | | 6/1989 | DiMatteo et al. | 5/81.1 |
| 4,868,938 | A | * | 9/1989 | Knouse | 5/88.1 |
| 4,947,418 | A | | 8/1990 | Barr et al. | 378/177 |
| 4,970,738 | A | | 11/1990 | Cole | 5/81.13 |
| 5,022,810 | A | | 6/1991 | Sherrow et al. | 414/501 |
| 5,033,132 | A | | 7/1991 | Greenblatt | 160/238 |
| 5,033,170 | A | | 7/1991 | Ewert | 24/459 |
| 5,038,424 | A | * | 8/1991 | Carter et al. | 5/81.1 C |
| 5,152,486 | A | | 10/1992 | Kabanek et al. | 248/201 |
| 5,161,276 | A | | 11/1992 | Hutton | 5/498 |
| 5,163,189 | A | | 11/1992 | DeGray | 5/86.1 |
| 5,213,580 | A | | 5/1993 | Slepian et al. | 623/1 |
| 5,236,390 | A | | 8/1993 | Young | 454/95 |
| 5,279,010 | A | | 1/1994 | Ferrand et al. | 5/600 |
| 5,340,266 | A | | 8/1994 | Hodgetts | 414/527 |
| 5,353,453 | A | | 10/1994 | Naumann | 5/417 |
| 5,435,323 | A | | 7/1995 | Rudy | 5/628 |
| 5,544,371 | A | | 8/1996 | Fuller | 5/88.1 |
| 5,697,109 | A | * | 12/1997 | Hodgetts | 5/81.1 HS |
| 5,819,339 | A | * | 10/1998 | Hodgetts | 5/88.1 |
| 6,289,533 | B1 | * | 9/2001 | Hodgetts | 5/81.1 R |

* cited by examiner

PATIENT TRANSPORT SYSTEM

This application claims the benefit of No. 60/101,597 filed Sep. 24, 1998.

BACKGROUND OF THE INVENTION

1. Field of the Invention

This invention relates to patient transport systems, and more particularly, to a patient transport system for transferring an immobile patient from a bed to a gurney or vice versa.

2. Description of the Prior Art

It appears to be widely accepted that a major, if not the major, work-related complaint among nurses and hospital nursing staff is back injuries caused by lifting patients and getting them in and out of a bed and to and from a gurney or a stretcher as it is commonly referred to. A survey of existing practices and techniques suggests that there is no widely adopted simple and safe method of transferring patients from a bed to a gurney, or vice versa, without lifting them. There are hoist-type lifts where the patient is suspended in a sling. The sling must be first manipulated under the patient and then the patient must be physically lifted, changing the shape of the body and applying pressures different from those existing on the patient when lying prone in bed. There are also roller boards which are inserted partially under the patient and then the patient is pulled onto the roller board. Again,, the patient must be manipulated to allow the board to be inserted and then the body is pulled onto the board. In the end, the patient ends up on the board, not on the gurney or the bed. An additional disadvantage of the roller board is that either the patient must cooperate with the transferrer or more than one transferrer is required to effect the transfer. Patients have also been known to drop off the roller boards and to land on the floor between the bed and the gurney.

Also, previous inventions make use of conveyors external to both the bed and the gurney in which the patient is passed from one to the other which results in unnecessary and complex devices and cannot accommodate different sized beds. Such devices are set forth in U.S. Pat. Nos. 5,163,189; 4,776,047; 4,761,841; 3,810,263; 3,769,642; 3,593,351; 3,413,663; 3,302,219; 2,733,452; 2,630,583; 2,536,707; 1,487,171; 1,263,611; 716,886; and 378,220.

Therefore, it is an object of the invention to allow a patient, while lying in the prone position and completely immobile, to be moved by one person of relatively low strength smoothly and safely from a bed onto a gurney and vice versa.

It is also an object of the invention to allow a patient, while lying in a prone position and completely immobile, to be moved by one person of relatively low strength, safely from the bed to the gurney and vice versa, and to accommodate various bed lengths with one conveying apparatus.

It is also an object of the invention to provide a patient transport system for a bed or a gurney which can be easily engaged with the bed or gurney and removed.

SUMMARY OF THE INVENTION

The invention is an apparatus for transporting a patient that includes a base, a patient supporting member attached to the base, a conveyor secured (either fixedly or removably) to the base, and a sheet. The sheet has a first end and a second end, where the first end is attached to the conveyor. The sheet is adapted to be positioned onto the patient supporting member. The base and the patient supporting member can form a bed, a gurney or an apparatus that converts from a gurney to a wheelchair or vice versa.

The conveyor includes a roller rotatably secured to the base, where the roller can be made of graphite fibers, aluminum, fiberglass or steel. The roller includes a first end and a second end. The sheet first end is attached to the roller and two bearings which are removably and rotatably secured to respective first and second ends of the roller.

Each bearing includes a first leg and a second leg attached to the first leg. The first and second legs define an open ended roller receiving recess that receives an end of the roller. A tip extends from one of the legs into the roller recess. Preferably, the tip extends from the first leg, which includes an inner surface having a first section and a second section, where the tip extends at an interface of the two sections. The second leg includes a first segment and a depending second segment. The second segment is secured to the first leg. Inner surfaces of the first segment, second segment and second section define a roller engaging recess. The second section inner surface is concave shaped.

A pair of collars are provided on both ends of the roller, wherein the bearings are received between the collars.

The sheet is removably attached to the conveyor by a flexible strap having one end releasably attached to the roller and the other end releasably attached to the sheet. Preferably, a clip is releasably secured at one end of the strap for attaching to the sheet. The clip can include a body defining a slot and a plug received in the slot. The plug is adapted to sandwich and bind a portion of the sheet between the plug and the body. The length of the strap can be adjusted. Preferably, Velcro® fasteners are provided on an end of the strap and along the length of the roller so the strap can be releasably secured to the roller.

The roller can be provided with a telescopic arrangement so that its length can be adjusted, wherein the roller includes a first longitudinally extending member that slidably receives a second longitudinally extending member with a recess defined in the first longitudinally extending member. Preferably, the recess has the same geometric shape as a cross-sectional shape of the second longitudinal member. A segmented handle can be attached to the roller. An annular member is slidably received by the second longitudinally extending member and a flexible strip is secured to the annular member.

A tube can be attached to the base and a post can be attached to the bearing, or vice versa. The post is slidably received by the tube so that the bearing is removably secured to the base. A pawl and ratchet arrangement can be secured to the roller and bearing to prevent the roller from rotating in a defined direction.

The invention can be used on a bed, a gurney or a convertible gurney that converts from a gurney to a wheelchair.

The invention is also a method for transporting a patient from a bed to a gurney or vice versa using the above-described conveyor including the steps of: placing a sheet on one of the mattress of the bed and the patient supporting surface of the gurney, positioning the patient on the sheet, attaching the conveyor to the other of the bed and the gurney having the sheet, positioning the gurney adjacent to the bed so that the conveyor is along a side of the other of the gurney and the bed, the side being furthest away from the one of the bed and the gurney having the sheet, removably attaching the sheet to the roller, rotating the roller and thereby winding the sheet around the roller, moving the patient on the sheet from the one of the bed and gurney toward the roller onto the other of the bed and the roller, and removing the roller from the one of the bed and the gurney.

The present invention is also a flexible strap for use with the above-identified apparatus that includes a flexible body having a first side, a second side, a first end and a second end. Hook type fasteners are positioned adjacent the first end and the second end on the second side of the strap. A loop type fastener is positioned between the hook type fasteners on the second side of the strap. A hook type fastener is positioned on the first side of the strap, wherein the hook type fasteners on the second side of the strap are adapted to form strap loops with the loop type fastener on the second side of the strap.

The method can also include the steps of attaching the sheet to straps secured to the roller and adjusting the length of the straps after the patient begins to be moved on the sheet so that all of the straps are taut.

DESCRIPTION OF THE PREFERRED EMBODIMENTS

Figure 1:
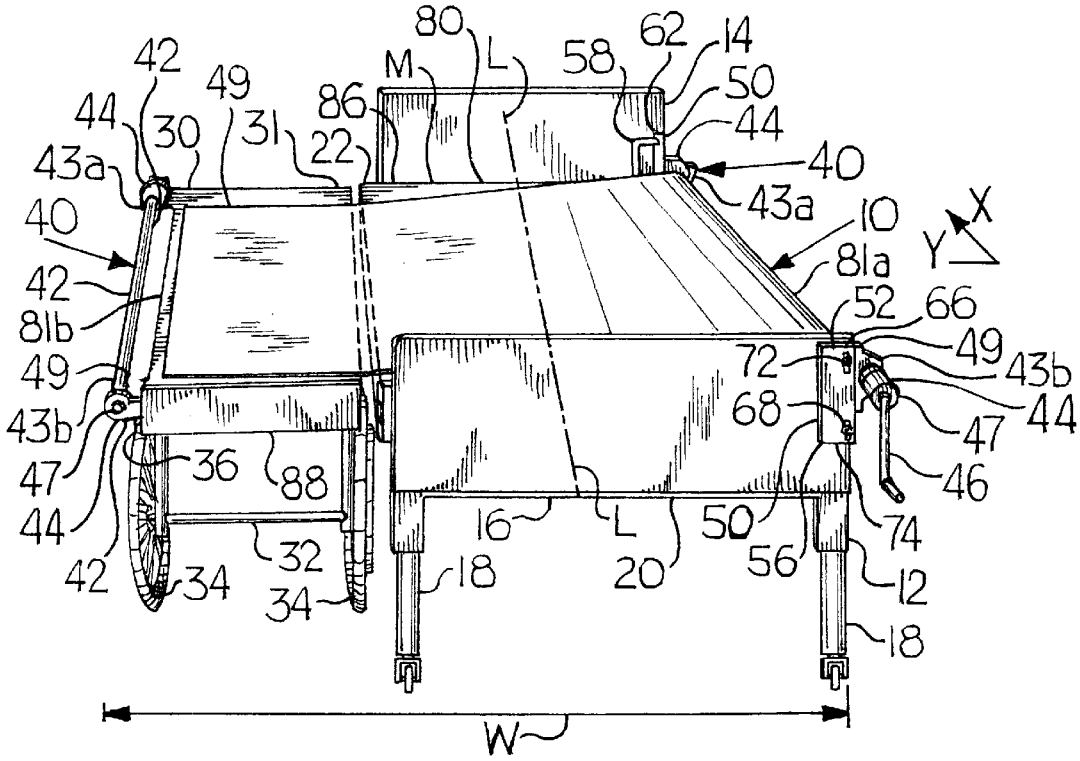
FIG. 1 is a perspective view of a gurney, a hospital bed and a conveyor.

Referring to FIGS. 1–9, there is shown a bed and a gurney having a conveyor in accordance with the present invention. Specifically, FIG. 1 shows a bed 10 that includes a bed frame or base 12 having a headboard 14, a baseboard 16, legs 18 attached to headboard 14 and baseboard 16, and a mattress supporting frame 20 attached to headboard 14 and baseboard 16 and legs 18. A mattress 22 is supported by mattress supporting frame 20. A gurney or stretcher 30, which is positioned directly adjacent to a side 31 of mattress 20 of bed 10, includes a frame or base 32 having wheels 34 attached thereto (throughout the specification, gurney and stretcher are used interchangeably). A patient supporting member 36 is supported by frame 32. Both mattress 20 and patient supporting member 36 extend in a first longitudinal direction shown by the arrow X.

As can be seen in FIG. 1, both bed 10 and gurney 30 have a conveyor 40 attached thereto. Each conveyor 40 includes a roller 42 having two ends or end portions 43*a* and 43*b*. Each end portion 43*a* and 43*b* is rotatably received by or rotatably coupled to a respective bearing unit 44. Thus, bearing units 44 are positioned near opposite ends of roller 42. A removable handle 46 or rotating member is received by a coupling 47 attached to end 43*b* of roller 42. Each bearing unit 44 includes a low friction bearing member, such as the Fafnir R.P.B. bearing and a housing 48. Roller 42, bearing unit 44, handle 46, and coupling 47 are similar to those used in Loadhandler Industries, Inc. LH-1000 Unloader described in U.S. Pat. No. 5,340,266 and PCT Application Ser. No. US94/07816, which are hereby incorporated by reference. Each housing 48 includes an attaching member plate 49. Plate 49 attaches to gurney 30 or bed 10 either by welding plate 49 to gurney frame 32 or bed frame 12, or by fastening plate 49 to gurney frame 32 or bed frame 12, through fasteners, such as screws.

Figure 2:
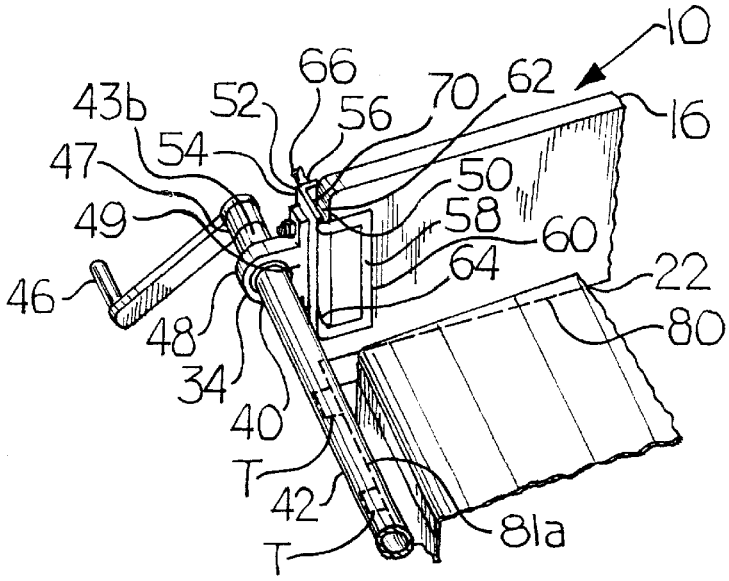
FIG. 2 is a partial top view of a portion of the bed and the conveyor shown in FIG. 1.

Alternatively, each plate 49 can be attached to or coupled to a conveyor attaching member 50. Each member 50 includes an L-shaped plate 52 having a first leg 54 and a second leg 56 extending therefrom. A second member 58 is provided having a U-shaped portion 60. Two legs 62 and 64 depend from U-shaped portion 60. Preferably, member 58 is formed by bending a metallic rod having a circular cross-section. Legs 62 and 64 have threaded ends 66 and 68, respectively. Two holes are defined in leg 56 of L-shaped plate 52 through which legs 62 and 64 pass, respectively. A recess 70 is defined between L-shaped plate 52 and second member 58. Either headboard 14 or baseboard 16 of bed 10 is positioned within recess 70, as shown in FIGS. 1 and 2.

Conveyor 40 attaches to or is coupled to bed 10 as follows. First, second leg 56 of L-shaped plate 52 and U-shaped portion 60 of second member 58, which are secured to one of bearing units 44, are pressed against respective sides of headboard 14. Then, second leg 56 and U-shaped portion 60 are held in place by wing nuts 72 and 74, which are threadably received by respective threaded ends 66 and 68 of legs 62 and 64 and abut against respective second legs 56. Wing nuts 72 and 74 are tightened sufficiently to hold, through frictional forces, attaching member 50 to headboard 14. The same process is then repeated for second leg 56 and U-shaped portion 60 of the other bearing unit 44, which is secured to baseboard 16, thereby holding conveyor 40 in place.

A sheet 80, such as a bed sheet, is releasably attached to roller 42. Preferably, sheet 80 is at least two times the width W of bed 10 and gurney 30, when bed 10 and gurney 30 are positioned adjacent one another, as shown in FIG. 1. An end 81*a* of sheet 80 is releasably attached to roller 42 with adhesive tape T, shown in phantom, such as cloth backed first aid tape or duct tape. Opposite end of sheet 81*b* is unsecured and is a free end. Preferably, sheet 80 is made from high quality fabric, such as cotton or polyester, with at least 180 threads per inch weave construction, although any type of sheeting material which can support a body can be used. A queen size bed sheet works satisfactory for use with a twin size mattress. Conveyor 40 is adapted to move sheet 80, and in turn a patient 100, in a second longitudinal direction shown by arrow Y, which is transverse to the first longitudinal direction shown by the arrow X.

Moving patient 100 using conveyor 40 is described hereinbelow.

a) Moving a Patient from the Bed to the Gurney

Figure 3:
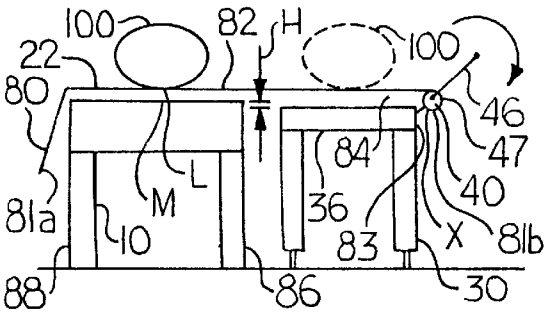
FIG. 3 is a schematic side view of a bed, a gurney and a conveyor attached to the gurney for moving a patient from the bed to the gurney.

As shown in FIG. 3, initially patient 100 is lying in a prone position on bed 10 preferably on or near longitudinal centerline L of sheet 80. Typically, sheet 80 is secured to bed 10 by tucking sheet 80 under mattress 20. Sheet 80 is then untucked or unsecured from bed 10 and an edge 81*b* of sheet 80 closest to gurney 30 is extended across gurney 30. Conveyor 40 is attached to gurney 30 at a side 83 of gurney 30 furthest from bed 10. Edge 81*b* of sheet 80 is releasably attached to roller 42 using, for example, adhesive tape. Preferably, bed 10 and gurney 30 are adjusted so that an upper surface 82 of mattress 20 is approximately two inches higher H than an upper surface 84 of patient supporting member 36. Height adjusting mechanisms for hospital beds and gurneys are well known in the art. Roller 42 is then slowly rotated about a longitudinal axis X passing through roller 42, so that preferably at least two complete wraps of sheet 80 are wound onto roller 42. Handle 46 is then inserted into or attached to coupling 47 of conveyor 40. Roller 42 is then rotated about longitudinal axis X, so that sheet 80 continues to be wound onto roller 42. This causes sheet 80 with patient 100 lying on an upper surface thereof to slide across upper surface 82 of mattress 10 and upper surface 84 of gurney supporting member 36, thereby causing patient 100 to be moved from bed 10 to gurney 30, as shown in phantom in FIG. 3. Any remaining part of sheet 80 on bed 10 after patient 100 is transferred to gurney 30 can be placed over patient 100. Patient 100 can then be transported by gurney 30.

b) Moving a Patient from the Gurney to the Bed

Figure 4:
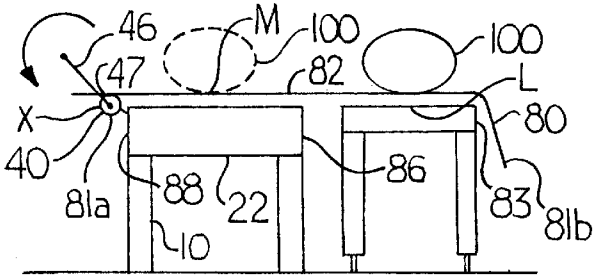
FIG. 4 is a schematic view of a bed, gurney and a conveyor attached to the bed for moving a patient from the gurney to the bed.
Figure 6:
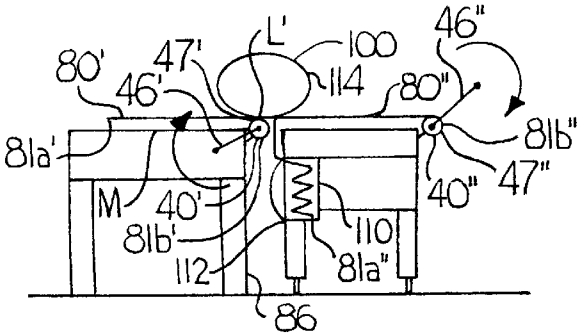
FIGS. 5–9 are schematic views showing a bed, a gurney and a conveyor for moving a patient to and from the bed and the gurney for the purposes of changing a bed sheet on the bed.
Figure 5:
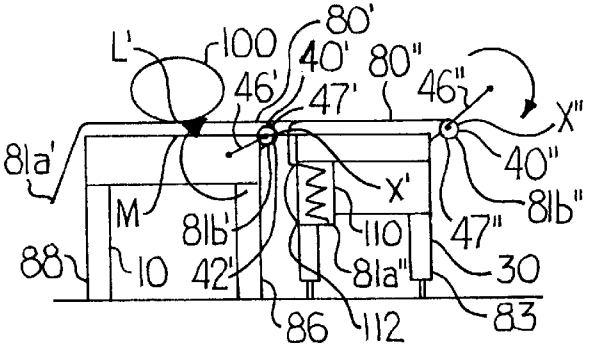
Figure 7:
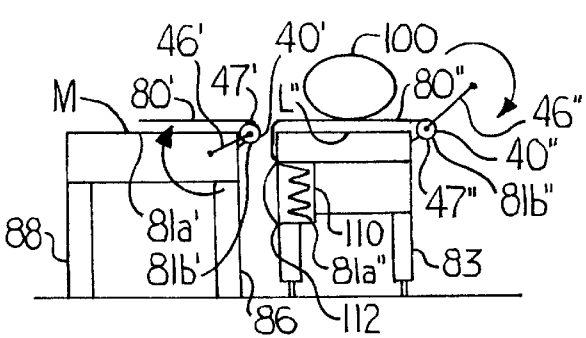

As shown in FIG. 4, initially patient 100 is lying in a prone position on gurney 30. Specifically, the patient is lying on or near longitudinal centerline L of sheet 80 resting on upper surface 84 of patient supporting member 36. Gurney 30 is positioned along a side 86 of bed 10. Conveyor 40 is attached to bed 10 on side 88 of bed 10 furthest from gurney 30. Edge 81*a* of sheet 80 closest to bed 10 is removably attached to roller 42 with, for example, four or five short pieces of adhesive tape as previously described. Preferably, bed 10 and gurney 30 are adjusted so that upper surface 82 of mattress 20 is approximately two inches above upper surface 84 of patient supporting member 36. Roller 42 is then slowly rotated about longitudinal axis X so that preferably at least two complete wraps of sheet 80 are wound onto roller 42. Handle 46 is then inserted into or attached to coupling 47 of conveyor 40 and roller 42 is rotated about the longitudinal axis X so that sheet 80 continues to be wound onto roller 42. This causes patient 100 to be moved from gurney 30 onto bed 10 in a manner similar to moving patient 100 from bed 10 to gurney 30. Roller 42 is rotated until the patient is located in a middle section M of bed 10. Sheet 80 is then removed from roller 42 by removing the adhesive tape and can be secured to bed 10 by tucking sheet 80 under mattress 20. Conveyor 40 may then be removed from bed 10.

c) Changing Sheets on a Bed of a Prone, Immobile Patient without Lifting or Manipulating the Patient FIGS. 5–9 show a method for changing sheets on bed 10 of a prone, immobile patient without lifting or manipulating the patient. At least two conveyors 40 are required and are designated 40' and 40". A first conveyor 40' attaches to side 85 of bed 10 and a second conveyor 40" attaches to side 83 of gurney 30 as shown in FIG. 5. Conveyors 40' and 40" are the same as conveyor 40 previously described. Initially, patient 100 is on bed sheet 80 on bed 10, lying essentially on longitudinal centerline L' on sheet 80'. Sheet 80', which is positioned under patient 100, is unsecured or untucked and removably attached at longitudinal edge 81*b*' with adhesive tape, or another type of removable fastener, to roller 42'. Then roller 42' is turned slowly by hand so that preferably at least two wraps of sheet 80' are wound around roller 42'. A fresh sheet 80" is then laid across patient supporting member 36 of gurney 30. Longitudinal edge 81*b*' of sheet 80" is attached with adhesive tape to roller 42". Then roller 42" is turned slowly by hand so that preferably at least two wraps of sheet 80" are wound around roller 42'. Loose end 81*a*" of fresh sheet 80" is gathered and folded concertina style and laid in a sheet retaining receptacle 110, as shown in FIGS. 5–9, positioned underneath a longitudinal edge 112 of gurney 30. Edge 112 of gurney 30 is positioned adjacent side 86 of bed 10 and conveyor 40' so that conveyor 40' is positioned between bed 10 and gurney 30, and conveyor 40" of gurney 30 is positioned on the side of gurney 30 furthest from bed 10. Preferably, bed 10 and gurney 30 are adjusted so that upper surface 82 of mattress 20 is about two inches above upper surface 84 of patient supporting member 36 and an upper horizontal tangent of roller 42' should be approximately one inch below surface 82. Preferably, gurney 30 is then clamped to bed 10 using any sort of clamping device, for example, a C-clamp, although locking the wheels of gurney 30 will also suffice. Handle 46' is then inserted into or attached to coupling 47' of conveyor 40' and turned, moving patient 100 toward gurney 30, until a shoulder of patient 100 is positioned over gurney 30 and starts to push fresh sheet 80" across gurney 30 toward side 83, as shown in FIG. 6. Second handle 46" is then inserted into or attached to coupling 47" of conveyor 40". Handle 46" should then be rotated about a longitudinal axis X" moving fresh sheet 80" and patient 100 onto gurney 30, as shown in FIG. 7. Preferably, handle 46" should continue to be rotated while handle 46" is rotated.

Figure 8:
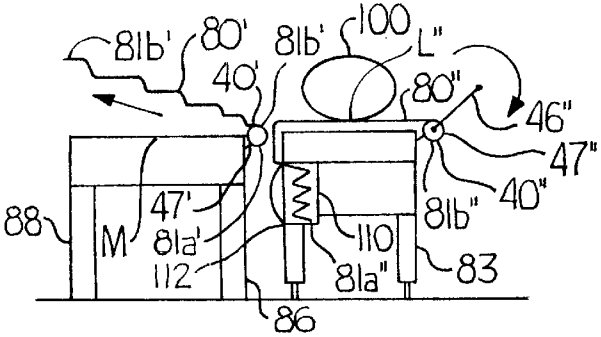
Figure 9:
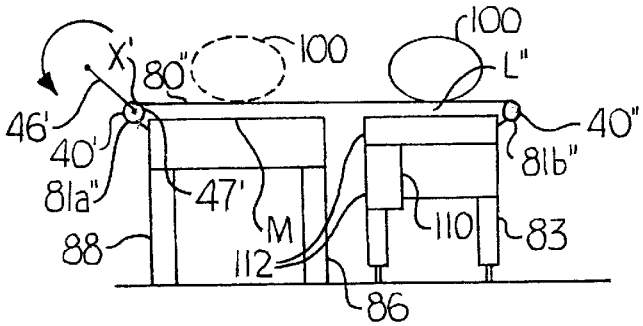

Once patient 100 is on gurney 30, rotation of handles 46' and 46" is stopped and sheet 80" is removed from bed 10 and conveyor 40' by grasping free edge 81*b*' of sheet 80' lying on bed 10 and pulling it off roller 42', as shown in FIG. 8. Conveyor 40' is then moved and attached to side 88 of bed 10, i.e., to the side furthest away from gurney 30, as shown in FIG. 9. Free edge 81*a*" of sheet 80" is extended across mattress 20 of bed 10 and removably attached to roller 42'. Handle 46' is then attached or inserted into coupling 47' of conveyor 40' and rotated about the longitudinal axis X', as previously discussed, thereby wrapping sheet 80" around roller 42'. Patient 100 is then moved by sheet 80", which is moved by conveyor 40', from gurney 30 onto bed 10 and is now lying on fresh sheet 80". Sheet 80" is then removed from rollers 42' and 42" and can be tucked under mattress 20 in an appropriate fashion. Sheet 80" can also be removed from roller 42" prior to its being wound around roller 42'. Conveyors 40' and 40" may then be removed from bed 10 and/or gurney 30.

It should be noted that conveyor 40 can include a motor in lieu of a handle to rotate roller 42. Further, conveyor 40 described above can be permanently affixed to bed 10 or gurney 30 and one or two conveyors may be attached to bed 10 and/or gurney 30. This depends on whether a conveyor 40 is attached to one side or both sides of bed 10 or gurney 30.

Conveyor 40 and the above-described methods for moving a patient from gurney 30 to bed 10 solve several problems in moving immobile patients. First, conveyor 40 is inexpensive to manufacture and simple to operate, and overcomes many of the problems involved in the complex conveying mechanisms presently known in the art. Further, conveyor 40 utilizes a bed sheet 80 which is then used on the bed. This eliminates the need to move the patient by lifting the patient from gurney 30 to bed 10 or vice versa. Further, the patient need not be physically lifted by a nurse's aid or nurse because the patient is transported by the sheet. This will minimize injuries to nurses, nurse's aides and patients in moving a patient from gurney 30 to bed 10 or vice versa. Furthermore, only one person is required to move the patient between gurney 30 and bed 10. This will result in a substantial labor cost savings associated with transferring patients.

A second embodiment of conveyor 40, as described in U.S. patent application Ser. No. 08/330,808 and identified as conveyor 200, is shown in FIGS. 10–20. Conveyor 200 is similar to conveyor 40 except conveyor 200 includes a clip 202. Like reference numerals are used for like parts.

Figure 10:
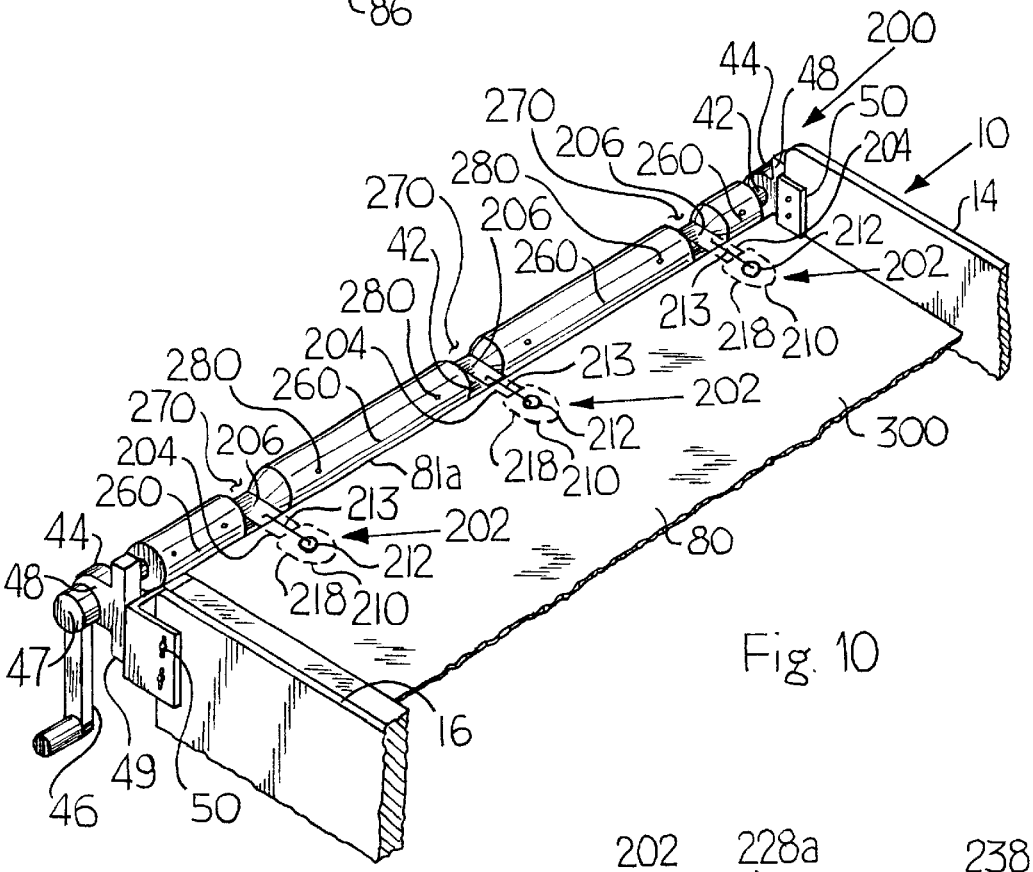
FIG. 10 shows a partial perspective view of a bed and a conveyor having a belt and a clip.

As shown in FIG. 10, conveyor 200 includes a roller 42, bearing units 44, and a removable handle 46 received by a coupling 47. Each bearing unit includes a low friction bearing and housing 48, which includes an attaching member plate 49. Each plate 49 can be attached to a conveyor attaching member 50.

Three fasteners or clips 202 are attached to roller 42. Specifically, each clip 202 is attached to an end 204 of a respective flexible belt 206. An opposite end 208 of belt 206 is attached to roller 42. Preferably, three or four belts 206 are spaced along roller 42. Belts 206 are permanently attached to roller 42, either by an adhesive or by mechanical fasteners. Belts 206 are made of a flexible material such as woven polypropylene, woven polyethylene or cotton. Belts 206 should be at least as long as the sheet being replaced, say three to four feet for a twin size bed.

As shown in FIGS. 10–16, each clip 202 includes a substantially flat body member 210 and a plug member 212. Preferably, plug member 212 is attached to belt 206 by a flexible string 213 to prevent plug member 212 from being misplaced (See FIG. 10). Body member 210 includes a first section 214 defining a belt receiving slot 216. Belt end 204 passes through slot 216 and is sewn to a section 218 of belt 206 to attach clip body member 210 to belt 206 (See FIG. 16). Alternatively, Velcro® fasteners can be provided on belt end 208 and belt section 218 so they can be releasably secured to each other. Using the Velcro® fastener permits adjustment of the length of belt 206.

Figure 12:
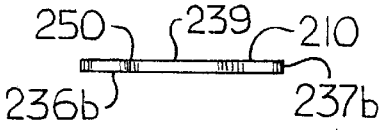
FIG. 12 is a front view of the clip body member shown in FIG. 11.
Figure 11:
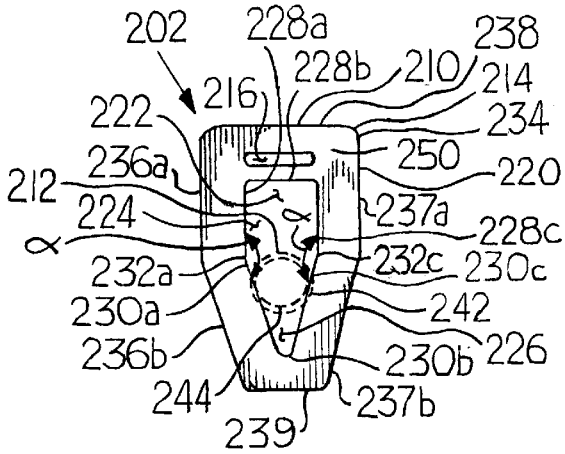
FIG. 11 is a too view of a clip body member.
Figure 16:
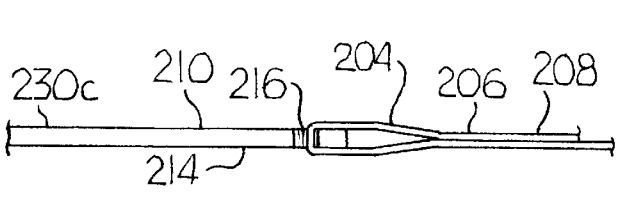
FIG. 16 is a sectional view of the body member and a belt.
Figure 18:
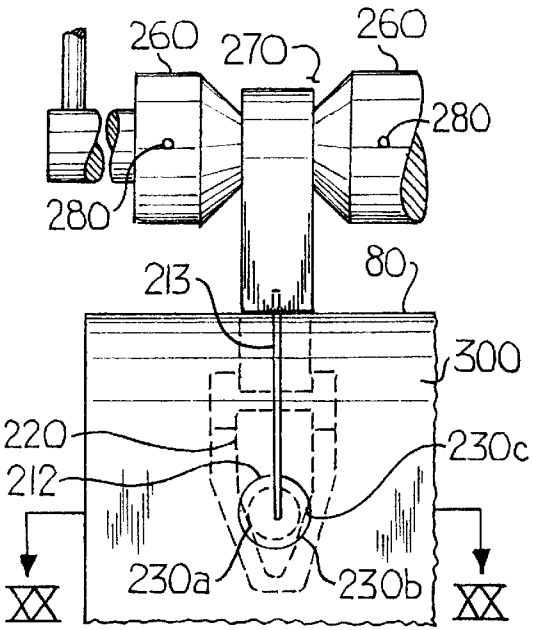
FIG. 18 is a top view of a portion of the conveyor shown in FIG. 10 with a sheet attached thereto.

As shown in FIGS. 11 and 12, body member 210 includes a second section 220 defining a plug member receiving slot 222. Slot 222 includes a rectangular shaped section 224 and a converging or triangular shaped section 226. Rectangular shaped section 224 is defined by three edges 228*a*, 228*b* and 228*c*. Edges 228*a* and 228*c* have a length $A_1$ and edge 228*b* has a length $A_2$. Triangular shaped section 226 includes three edges 230*a*, 230*b* and 230*c*. Edges 230*a* and 230*c* intersect edges 228*a* and 228*c* at intersection points 232*a* and 232*c*, wherein edges 228*a* and 228*c* and edges 230*a* and 230*c* are spaced apart a distance $A_2'$, which in this case is equal to $A_2$. Edge 230*b* has a length $A_3$. Edges 230*a* and 230*c* converge toward edge 230*b*. An angle $\alpha$ is defined by edges 230*a*, 230*c* and 228*a*, 228*c*, respectively, at points 232*a* and 232*c*. Body member 210 has an outer edge 234 including first sides 236*a*, 236*b*; second sides 237*a*, 237*b*; first end 238 and second end 239 having lengths $A_4$, $A_5$, $A_6$, $A_7$, $A_8$, and $A_9$, respectively. Preferably, body member 210 is made from high density polyethylene, ultra high molecular weight polyethylene, such as Solidor® by Phillips Petroleum, polypropylene or polyolefin, which is flexible and yet sufficiently strong so as not to fail when used.

Body member 210 can be fabricated or molded. An actual body member has been fabricated wherein length $A_1$ is 1.25 inches, length $A_2$ is 1.5 inches, length $A_3$ is 0.5 inches and angle $\alpha$ is 165°. Body member 212 was made of high density polyethylene having a thickness of 0.125 inches. Lengths $A_4$–$A_9$ are approximately 2.25 inches, 2.5 inches, 2.25 inches, 2.5 inches, 3 inches and 1.5 inches. Slot 216 has dimensions of approximately 1.5 inches and 0.25 inches wide.

Figure 14:
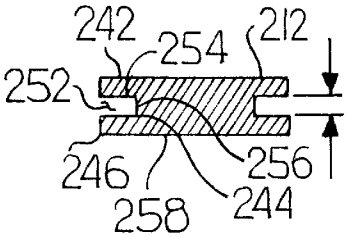
FIG. 14 is a section taken along line XIV—XIV of FIG. 13.
Figure 17:
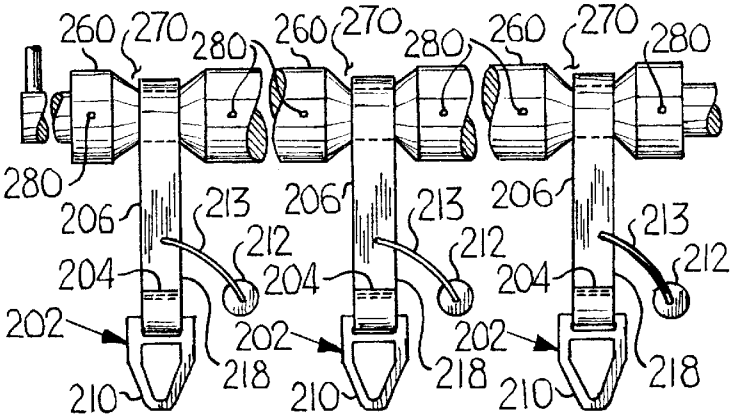
FIG. 17 is a top view of a portion of the conveyor shown in FIG. 10.
Figure 13:
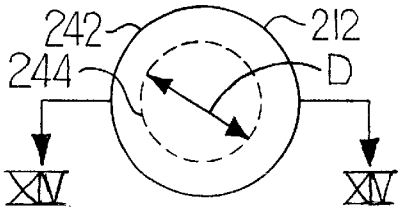
FIG. 13 is a top view of a clip plug member.
Figure 15:
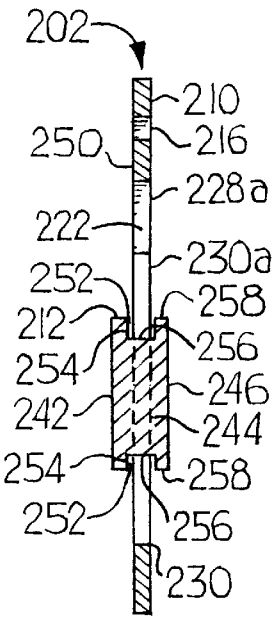
FIG. 15 is a sectional view of the body member and plug member.
Figure 19:
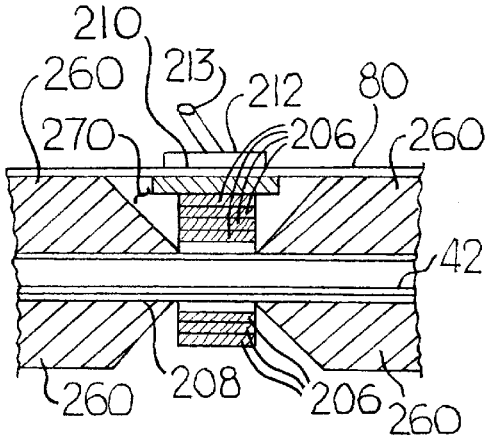
FIG. 19 is a partial sectional view of the conveyor shown in FIG. 10 with the belt partially wrapped around the conveyor.
Figure 20:
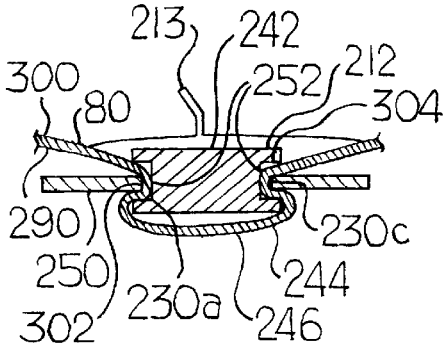
FIG. 20 is a section taken along line XX—XX of FIG. 18.

As shown in FIGS. 13 and 14, plug member 212 includes three circular shaped discs or members 242, 244 and 246, wherein disc 244 is sandwiched between and secured to discs 242 and 246. Disc 244 has a geometric diameter D, which is less than the diameter of discs 242 and 246. The diameter of disc 244 is less than $A_2'$, but greater than length $A_3$. Preferably, discs 242 and 246 have the same diameter, which is less than or equal to $A_1$ or $A_2$, so that plug 212 can pass through rectangular shaped section 224. Alternatively, disc 242 can have a diameter greater than length $A_2$ and rests on an upper surface 250 of body member 212, so that discs 244 and 246 can pass only through section 224. The thickness "t" of disc 244, and in turn, the spacing between discs 242 and 246 preferably are the same or slightly greater than the thickness of body member 210 (See FIG. 15). A body member receiving recess 252 is defined by surfaces 254, 256 and 258 of discs 242, 244 and 246, respectively. Preferably, plug 240 should be made of rubber and molded in one piece, such as EPDM rubber, having a Shore hardness on the A scale of 60–70.

An actual plug 240 has been made wherein discs 242 and 246 each have a diameter of 1.5 inches and disc 244 has a diameter of 0.75 inches and a thickness of 0.125 inches.

Conveyor 200 also includes a plurality of sleeves 260 secured to roller 42, as shown in FIGS. 10 and 17–19. Sleeves 260 are substantially hollow cylindrical members that slide over roller 42 and are positioned apart a distance slightly greater than the width of belts 206, so as to define a belt receiving recess 270 (See FIGS. 17–19). Sleeves 260 are attached to roller 42 by set screws 280. By use of belts 206 of sufficient length, say 3–4 feet, a standard size bed sheet can be used in lieu of an oversized bed sheet as previously discussed, i.e., a twin size standard bed sheet for a twin size bed mattress as opposed to a queen size bed sheet for a twin size bed mattress.

The above-described methods for transferring a patient are the same when using either the clip 202 or tape T, except that rather than taping sheet 80, 80' or 80" to roller 42, sheet 80, 80' or 80" is clipped to roller 42 as explained below. First, in the case of moving a patient from bed 10 to gurney 30, sheet 80, for example, is untucked. Each belt 206 is extended so that an underside 290 of sheet 80 rests on upper surface 250 of body member 210 (See FIGS. 10, 18 and 20). Plug member 212 is then placed on an upper surface 300 of sheet 80 directly over rectangular section recess 220. Each respective plug member 212 is then pressed against sheet 80 and moved towards edge 230*b* until edges 230*a* and 230*c* are received in recess 252. Plug member 212 is further moved toward end 230*b* until sheet 80 is bound and sandwiched between discs 242, 244, 246 and portions of edges 230*a*, 230*c* at interfaces 302 and 304 so that plug member 212 coacts with portions of edges 230*a* and 230*b* to releasably attach sheet 80 to conveyor 40 (See FIG. 20).

Roller 42 is then rotated as previously discussed. Belts 206 are wound on roller 42 and are received in respective recesses 270 with sleeves 260 acting as guides for belts 206. This in turn causes sheet 80 to be pulled toward roller 42 by clips 202 and belts 206. Continued rotation of roller 42 forces each plug member 212 to move toward a respective edge 230*b*, thereby firmly securing sheet 80 to the respective clip 202. Continued rotation of roller 42 causes belts 206 and clips 202 to be wound onto roller 42. Preferably, clips 202 are flexible enough to wrap around roller 42. Continued rotation of roller 42 causes sheet 80 to wrap around roller 42 (See FIG. 19). This causes patient 100 to be moved by sheet 80 from bed 10 to gurney 30 as previously discussed. To remove sheet 80 from roller 42, roller 42 is unwound until clips 202 are exposed. Each plug member 212 is moved toward the respective edge 228*b*, so that plug member 212 unbinds sheet 80. Each plug member 212 is removed from slot 222 and away from sheet 80, so that each clip 202 disengages from sheet 80. Hence, clips 202 releasably attach sheet 80 to conveyor 40. Clip 202 can be used in lieu of tape T for any of the described methods.

Clip 202 can also be used for securing other sheet material or membranes, such as boat covers, car covers, flexible covers or tarpaulins.

Figure 21:
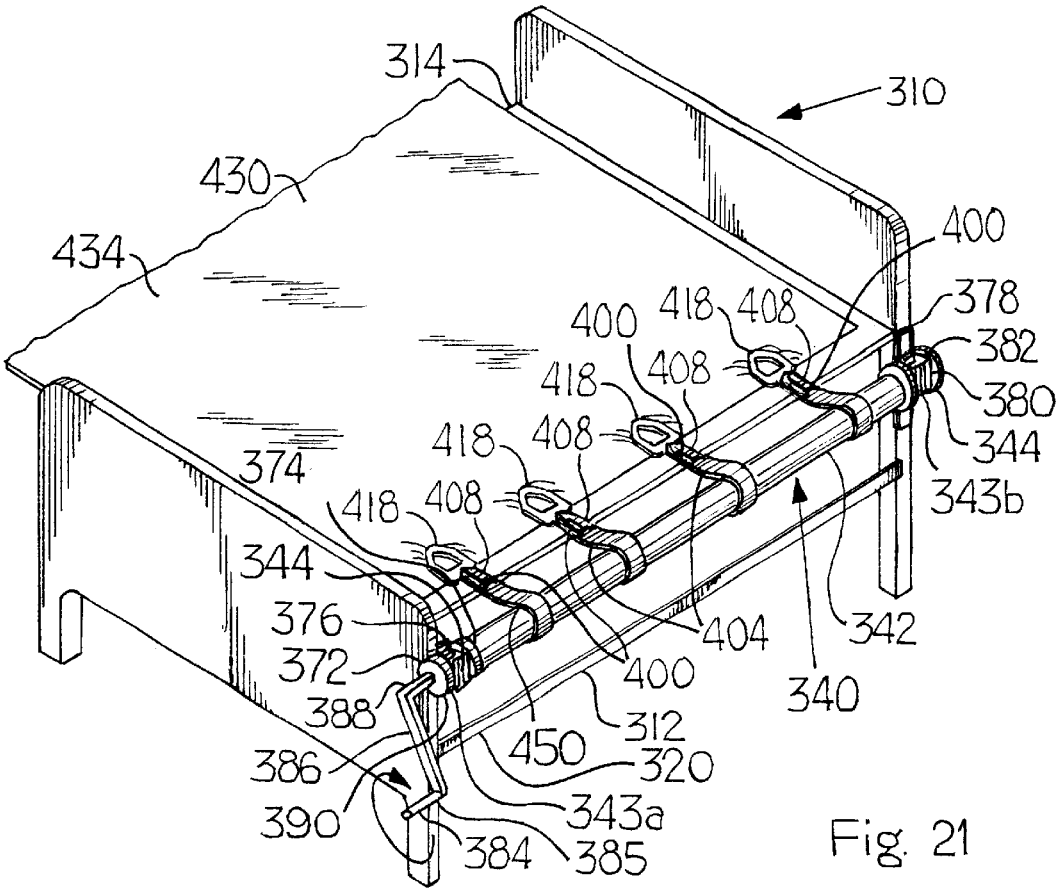
FIG. 21 is a perspective view of a hospital bed and a conveyor made in accordance with the present invention.

Referring to FIG. 21 of the drawings, there is shown a bed 310 (which is similar to bed 10) having a conveyor made in accordance with the present invention. Bed 310 includes a bed frame base 312 having a headboard, a baseboard, legs and a mattress supporting frame. A mattress 314 is supported by the mattress supporting frame.

Figure 23:
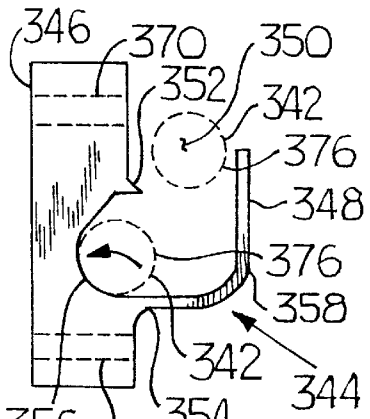
FIG. 23 is a side view of a bearing of the conveyor shown in FIG. 21.
Figure 22:
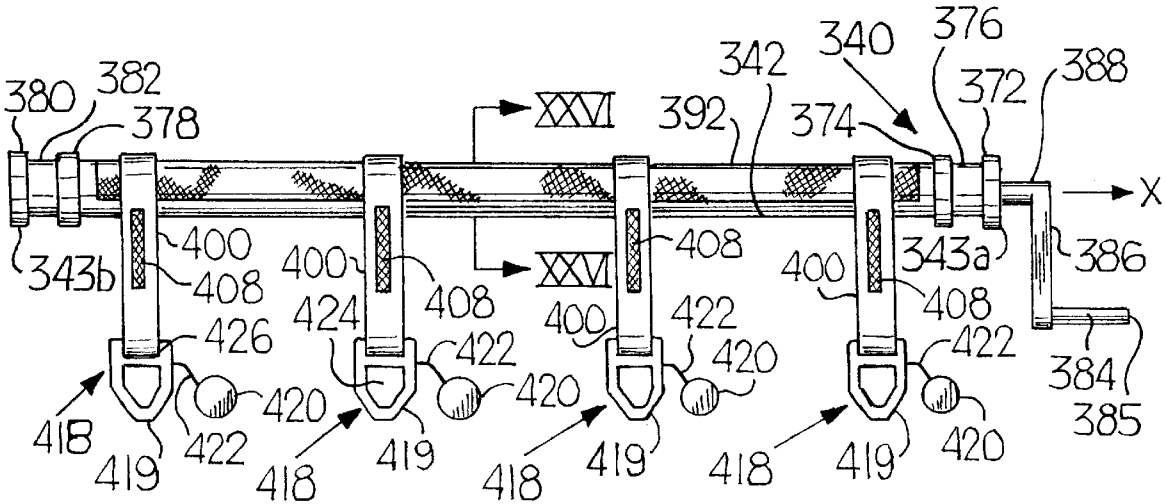
FIG. 22 is a plan view of a roller assembly of the conveyor shown in FIG. 21.

As shown in FIGS. 21 and 22 of the drawings, a conveyor 340 attaches to bed 310. Conveyor 340 can be used in lieu of the previously described conveyors 40 and 200 to transport patients. The conveyor 340 includes a roller 342 having two ends or end portions 343*a* and 343*b*. Each end portions 343*a* and 343*b* is rotatably received or rotatably coupled to a respective bearing unit 344. As shown in FIG. 23 of the drawings, each bearing unit 344 includes a first leg 346 and a second L-shaped leg 348 integrally attached thereto, which defines an upwardly facing, open-ended slot 350 for receiving end portions 343*a* and 343*b* of roller 342. A tab 352 protrudes or extends from leg 346 dividing leg 346 into two sections. A locking recess 354 is defined by a C-shaped surface 356 defined in leg 348 and a portion of an inner surface 358 of leg 348. A lower end of the tab 352 defines an upper portion of the C-shaped surface 356. Preferably, bearing unit 344 is made out of a polymer material, such as high density polyethylene or ultra high molecular weight polyethylene. Preferably, each bearing unit 344 is secured to the bed by fasteners which pass through holes 370 defined in leg 346 or in any other manner. Although not shown, a similar bearing unit 344 can be attached to a gurney.

Roller 342 is substantially cylindrical in shape and extends substantially along the length of the bed 310. Preferably, the roller 342 is made of lightweight material, such as aluminum, plastic or other polymeric material, a graphite fiber material or a fiberglass material. Also, the roller 342 can be made of other metals, such as steel. The graphite fiber material can be pulltruded (i.e., the graphite fiber resin composition is pulled or drawn through an extrusion or forming die, which is well known in the art). The roller 342 includes two spaced apart collar members 372 and 374 at the first end 343*a*. A journal portion 376 is defined between collar members 372 and 374. Two spaced apart collar members 378 and 380 are provided at the second end 343*b* of the roller 342. A journal portion 382 is defined between collar members 372 and 374. Journal portions 376 and 382 are removably received by respective bearing units 344. Specifically, journal portions 376 and 382 are positioned within the locking recesses 354 and are adapted to abut against respective C-shaped surfaces 356 of the bearing units 344. The distance between collar members 372 and 374 is greater than the thickness of the bearing unit 344. The same is true for collar members 378 and 380. The distance between the tab 352 and an upper portion of L-shaped leg 348 is less than the diameter of journal portions 376 and 382. Hence, the roller 342 can easily be received by the bearing units 344.

Figure 25:
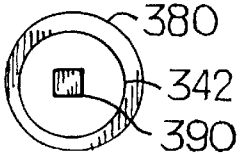
FIG. 25 is a view along line XXV—XXV of the roller shown in FIG. 22.
Figure 26:
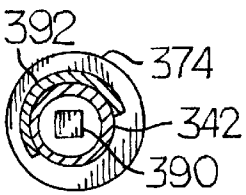
FIG. 26 is a section taken along line XXVI—XXVI of the roller shown in FIG. 22.
Figure 27:
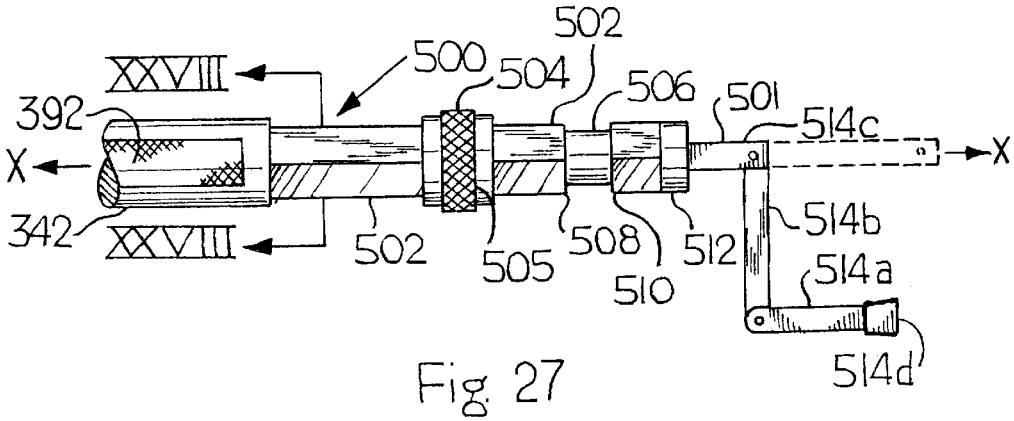
FIG. 27 is a partial view of another embodiment of the present invention showing a portion of a conveyor having a telescopic roller.
Figure 28:
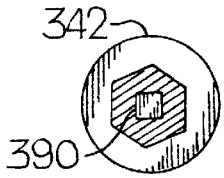
FIG. 28 is a section taken along lines XXVIII—XXVIII of FIG. 27.

A handle 384 is attached to an end of the roller 342. Handle 384 includes a hand-grabbing portion 385 and integral sections 386 and 388. Section 388 has a square cross-sectional profile and is adapted to be slidably received by square shaped slots 390 (as shown in FIG. 25 of the drawings) defined on opposite ends of the roller 342. A Velcro® strip 392 extends along the length of the roller 342 between collar members 374 and 378.

Figure 24A:
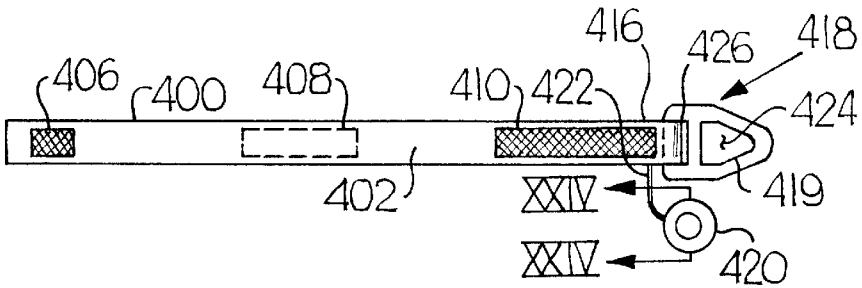
FIG. 24*a* is a top view of a strap and clip arrangement of the conveyor shown in FIG. 21.

FIGS. 21, 22 and 24*a* of the drawings show straps or belts 400 removably secured to the roller 342. Preferably, four straps 400 are provided, although more or less straps 400 may be necessary to move a patient. Each strap 400 includes a first side 402 and a second side 404. Velcro® fasteners 406 and 410, i.e., hook and loop fasteners, which are well known in the art, are attached at opposite ends of side 402 of strap 400. A Velcro® fastener 408 is attached to a middle portion of side 404 of strap 400. A clip 418 is attached to an end 416 of strap 400. Clip 418 includes a body member 419 and a plug member 420, which are similar to body member 210 and plug member 212 described previously herein. Straps 400 are spaced along the length of the roller 342. The straps 400 are made of flexible material, such as woven polyethylene, woven polypropylene or cotton. Preferably, the straps 400 should be at least as long as the bed sheet width. Fastener 408 (a loop fastener) is of sufficient length so that when the strap 400 is completely wound around the roller 342, it is releasably attached to fastener 410 (a hook fastener) and prevents the straps 400 from unwinding when the roller 342 is not in use.

The plug member 420 is attached to the strap 400 by a flexible string 422 to prevent the plug member 420 from being misplaced. The clip 418 includes a plug receiving slot 424 and a belt receiving slot 426. Preferably, the body 419 is made of high density polyethylene, ultra high molecular weight polyethylene, polypropylene, or other polyolefin, which is suitably flexible but sufficiently strong so as not to fail in use.

Figure 24B:
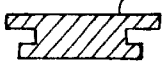
FIG. 24*b* is a section taken along line XXIVb—XXIVb of FIG. 24*a;*

Plug member 420 includes three circular shaped rubber discs (See FIGS. 24*a* and 24*b* of the drawings) arranged so that the plug member 420 can pass through a portion of the plug receiving slot 424 and engage the sides of the plug receiving slot 424 at another section thereof so as to sandwich the sheet between the plug member 420 and the clip body 419.

To attach a sheet 430 to the roller 342, first straps 400 are spaced across the roller 342, as shown in FIG. 21 of the drawings to match the patient's weight distribution, i.e., moving a heavy person may require two straps 400 to be positioned next to each other and aligned with the patient's buttocks or stomach. In other situations, the straps 400 may be positioned differently, such as equally spaced apart across the sheet to move the patient. Then, the Velcro® fastener 406 of each strap 400 is releasably secured to the Velcro® strip 392. Fasteners 406 are either the loop or hook of Velcro® fastener and the Velcro® strip 392 is the other of the loop or hook Velcro® fastener. Preferably, the straps 400 are of a sufficient length to permit the roller 342 to be rotated until all of the straps are wound around the roller 342 at least one in a half times. This prevents disengagement of fasteners 406 from the Velcro® strip 392 of the roller 342, when the straps 400 become taut. Then, the clips 418 are attached to the sheet 430 near an edge 432 as shown in FIG. 21 of the drawings. Each strap 400 is extended so that an upper side of the sheet 430 rests on a lower surface of the clip body 419. The plug member 420 is then placed on a lower surface of the sheet 430 directly under the plug receiving slot 424. Each respective plug member 420 is then pressed against the sheet 430 and moved toward the respective narrow portion of the plug receiving slot 424. The plug member 420 is moved within slot 424 until the sheet 430 is bound and sandwiched between the plug member 420 and the edges defining the plug receiving slot 424 so that the plug member 420 coacts with portions of the edges defined in plug receiving slot 424 to releasably attach the sheet 430 to the roller 342 of the conveyor 340 .

To move a patient from a gurney to the bed 310, where the patient is resting on an upper surface 434 of the sheet 430 on the gurney (not shown), the roller 342 is rotated by the handle 384 about a longitudinal axis by rotating handle 384 about the longitudinal axis. Straps 400 are wound on the roller 342, preferably so that the straps are initially wound about an upper tangent 450 of the roller 342. This causes sheet 430 to be pulled toward the roller 342 by clips 418 and straps 400. Rotation in a first direction of the roller 342 forces each plug member 420 to engage in the plug receiving slot 424, thereby further securing the sheet 430 to respective clip 418. Further, rotation of the roller 342 causes the journal portions 376 and 382 of the roller 342 to be pulled toward and against the C-shaped surface 356 which acts as the bearing surface. The upper portions of the C-shaped surface 356 defined by the tab 352 prevents the journal portions 376 and 384 from slipping out of the bearing units during the winding. Continued rotation of the roller 342 causes a patient lying on the surface 434 of the sheet 430 to be moved toward the bed 310 from the gurney and causes straps 400 and clips 418 to be wound on to the roller 342. Preferably, clips 418 are flexible enough to be wound around the roller 342. Continued rotation of the roller 342 causes the sheet 430 to wrap around the roller 342. Hence, the patient is moved by the sheet 430 from the gurney to the bed 310. The sheet 430 slides on an upper surface 434 of the mattress 322 during rotation. After the patient is positioned on the bed 310, the sheet 430 is removed from the roller 342 by unwinding the roller 342 to expose clips 418. Each plug member 420 is removed from the plug receiving slot 424 so that each clip 418 disengages from sheet 430. The roller 342 can then be removed from the bed 310 by lifting the journal portions 376 and 382 out of the respective bearing locking recesses 354. The above method can be reversed to move the patient from the bed to the gurney.

Figure 32:
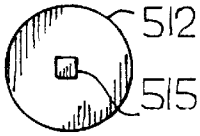
FIG. 32 is a front view of a top cap shown in FIG. 27.
Figure 30:
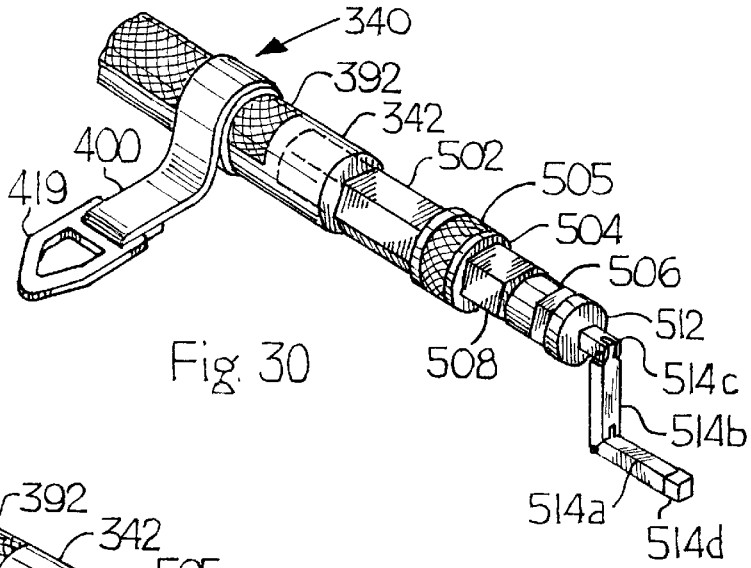
FIG. 30 is a perspective view of a portion of the conveyor roller shown in FIG. 27 in an extended position.

In some situations, the length of the beds found in hospitals can be varied. This is due to various bed frame lengths, as well as to the electric beds that change the position of the patient by moving the mattress. In that case, the roller 342 can be modified as shown in FIGS. 27–32 of the drawings. A telescopic arrangement 500 can be provided with roller 342. Telescopic arrangement 500 replaces end 343*a*, collar members 372 and 374, journal portion 376 and handle 384 of conveyor 340. A handle 501 is secured to an end on the telescopic arrangement 500. A hexagonally shaped hole is defined in the roller 342 at one end thereof and a hexagonally shaped telescoping member 502 is slidably received by the end of the roller 342 (See FIGS. 27 and 28 of the drawings). A sleeve 504 having a hexagonally shaped bore passing therethrough is slidably received by the hexagonally shaped telescopic member 502. A Velcro® strip 505 of a similar type as strip 392 is attached to the sleeve 504. A recessed journal portion 506 is defined at an end of the hexagonally shaped telescoping member 502. Guide surfaces 508 and 510 are defined by the telescoping member 502 adjacent the recessed journal portion 506. An end cap 512 is attached to an end of the telescoping member 502 and includes a square hole 513 as shown in FIG. 32.

Figure 29:
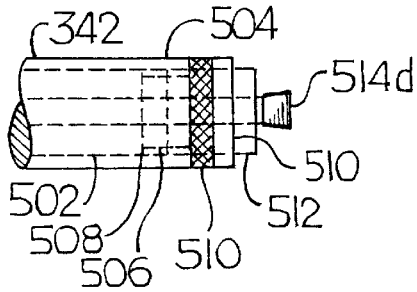
FIG. 29 is a partial plan view of the telescopic roller shown in FIG. 27 in a closed position.

The handle 501 includes segments 514*a*, 514*b* and 514*c*. Handle segments 514*a*, 514*b* and 514*c* are pivotally secured to each other and can be arranged in a straight position (as shown in phantom in FIG. 27 of the drawings) and slid through hole 513 as shown in FIG. 29 of the drawings. Segments 514*a*, 514*b* and 514*c* have a square cross-section. If the handle 501 is extended in a longitudinal direction to the straight portion, it can be slidably received by the telescoping member 502 through the hole 513 and a hole defined in telescoping member 502.

The outer perimeter of section 514*c* is slightly smaller than slot 513. Hence, rotating handle section 514*c* about the longitudinal axis X will rotate roller 342 about the longitudinal axis X. A stop 514*d* is attached to handle 501 and abuts end cap 512 when the handle 501 is passed through hole 513 as shown in FIGS. 29 and 31.

In operation, straps 400 can be placed on both the Velcro® strip 392 as well as the Velcro® strip 505 on sleeve 504. Recessed journal portion 506 is removably received by bearing unit 344. Operation of the modified roller is similar to that as previously discussed except that as the length of the bed 310 changes so does the length of the conveyor 340. Specifically, the hexagonally shaped telescoping member 502 will either slide in or slide out of the slot defined in the roller 342, thereby changing the overall length of the conveyor 340. Preferably, a strap 400 is attached to the Velcro® strip 505 of the sleeve 504 in a similar manner as previously discussed in attaching the strap 400 to the Velcro® strip 392. Rotation of the handle 501 about the longitudinal axis X will cause the telescoping member 502 to rotate about the longitudinal axis which, in turn, causes both the sleeve 504 and roller 342 to rotate about the longitudinal axis. This is due to the handle 501 coacting with the end cap 512, and the telescoping member 502 coacting with the sleeve 504, the roller 342 and end cap 512 about the longitudinal axis X.

Figure 31:
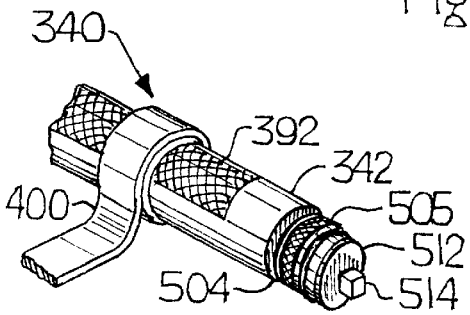
FIG. 31 is a perspective view of the conveyor roller shown in FIG. 30 in a retracted position.

After the patient is moved onto the bed 310 from the gurney, the roller 342 can be removed from the bearing units 344 as previously discussed and the handle 501 can be slid within telescoping member 502 which then can be slid within roller 342 to result in a compact design as shown in FIGS. 29 and 31 of the drawings. Alternatively, roller 342 can be permanently attached to a bed at journal portions 506 and 382 to bearings. Further, a non-folding handle 384 can replace handle 501 or vice versa. Furthermore, telescopic arrangements can be provided at both ends of the roller 342 as opposed to only one end.

Figure 33:
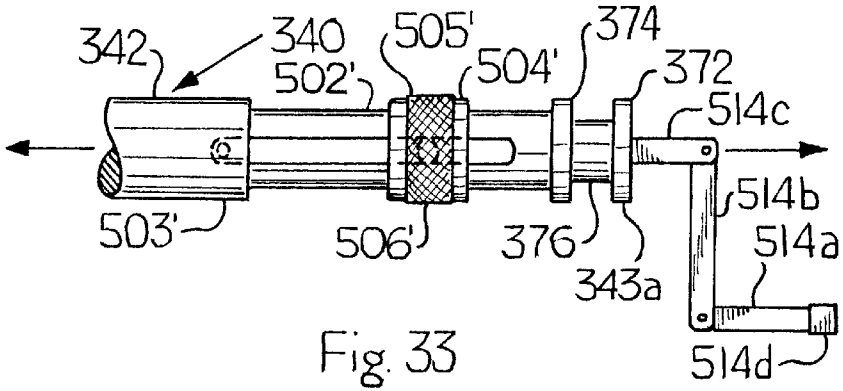
FIG. 33 is a partial view of another embodiment of the present invention showing a portion of a conveyor having a telescopic roller.

Another embodiment of the roller 342 is shown in FIG. 33. of the drawings. Telescoping member 502' is slidably received by roller 342 through a circular hole. An elongated slot is defined in member 502'. A pin 503' is secured to an end of roller 342 and passes through the slot and slidably guides member 502' along the X axis. A cylindrical sleeve 504' having a circular hole is slidably received on member 502'. A Velcro® strip 505', similar to the Velcro® strip 505, is attached to sleeve 504'. A pin 506' is secured to sleeve 504' and slidably passes through the slot. Collar members 372 and 374 and journal portion 376 (as previously described) are provided at an end of member 502'. A segmented handle 501 having segments 514*a*–514*c*, as previously described, is secured to collar member 372 and is adapted to pass through a square shaped slot defined in collar member 372 in a manner similar to the handle used in the embodiment shown in FIG. 27. The journal member 376 is adapted to be slidably received by bearing unit 344 as previously described. The features of the roller 342, shown in FIG. 33, can be combined with any of the other rollers 342 shown. The length of the roller 342 can be changed by extending the member 502' from the hole defined in the roller 342 or retracting the member 502' within the hole.

Figure 34:
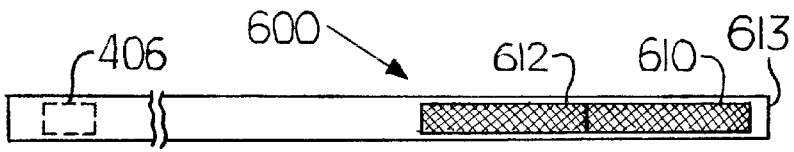
FIG. 34 is a top view of another embodiment of the strap made in accordance with the present invention.
Figure 35:
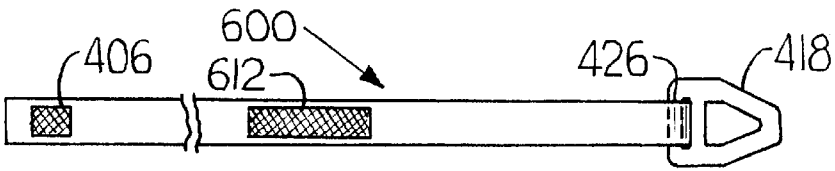
FIG. 35 is a top view of a clip and the strap of the embodiment shown in FIG. 34.

FIGS. 34 and 35 of the drawings, show another embodiment of a strap 600, which is similar to strap 400 except for the below-noted differences. I have found that sometimes the bed sheet stretches differentially due to the patient's unique weight distribution, and although the patient can be transferred, this differential stretching causes the patient's body to bend out of alignment. To overcome this problem, an alternative strap 600 can be provided having a Velcro® hook fastener portion 610 and a Velcro® loop fastener portion 612 positioned adjacent thereto. The clip 419 is removably received by a clip receiving end 613 of the strap 600. Specifically, the clip receiving end 613 of the strap 600 is looped through slot 426 of the clip 418 so that Velcro® portion 610 can contact Velcro® portion 612 and be releasably secured thereto. The straps 600 are then fastened to the roller in the same manner as straps 400 and clips 418 are releasably secured to the sheet 430 in the same manner previously described. The roller 342 is then wound as described above until at least one of the straps 600 becomes taut. At that time, the person rotating the roller places his or her thigh against the roller 342 so as to press the journal portions 376 and 382 of roller 342 against bearing surfaces 356, thereby preventing the roller from rotating about the longitudinal axis X. Then, all of the straps 600 can be made taut by releasing Velcro® sections 610 and 612 from each other, and pulling on each section 610 until each of the respective straps 600 is taut and then releasably resecuring section 610 to section 612. After this procedure is completed for each strap 600, the roller 342 is wound as previously described. It is believed that Velcro® sections 610 and 612 can be replaced by a buckle to adjust the length of the straps 600, as long as the buckle does not impede the straps, ability to be wound around the roller.

Figure 36:
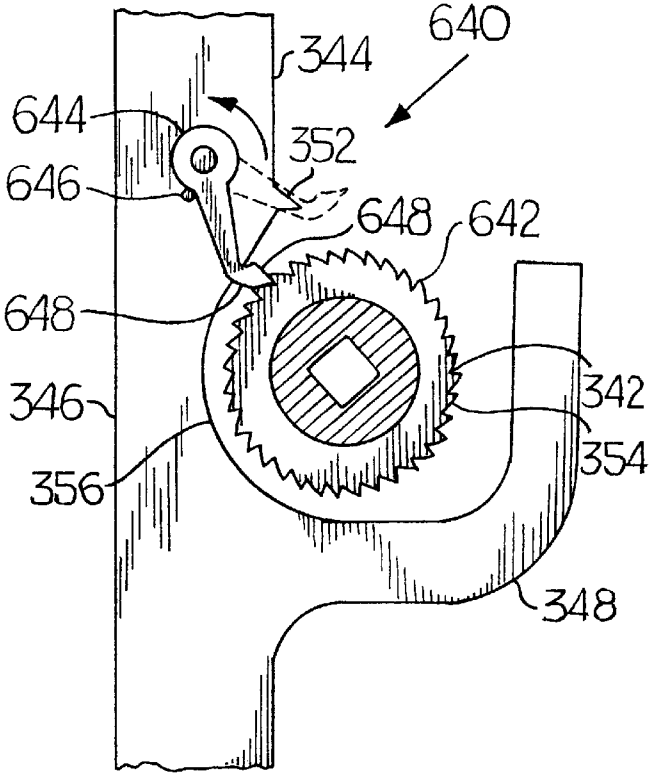
FIG. 36 is a partial side view of a locking mechanism used with the conveyor of the present invention.

Alternatively, a pawl and ratchet arrangement 640, as shown in FIG. 36 of the drawings, can be provided in lieu of using the thigh to stop the rollers. The pawl and ratchet arrangement 640, as shown, is used with the embodiment shown in FIGS. 21–27 of the drawings, but can be used with any of the described rollers. The pawl and ratchet arrangement 640 includes a toothed ratchet wheel 642 secured to an end of the roller 342 adjacent the collar member 372. A spring loaded pawl 644 is secured to a side wall of one of the bearing units 344. A torsional spring (not shown) is secured to the pawl 644 and the side wall of the bearing unit causes the pawl 644 to abut against a stop 646, such as a post, secured to and extending from the bearing side wall.

The roller 342 is secured to the bearing as previously described. As the roller is rotated about the longitudinal axis X in a first tightening direction (such as the clockwise direction), at least one of the straps 600 will become taut. The roller will be drawn toward the C-shaped surface 356 and pawl 644 will engage with the ratchet wheel 642, so that the pawl 644 is received between respective teeth 648 of the ratchet wheel 642. Any attempt to rotate the roller in a second direction (i.e., the counterclockwise direction) to unwind the roller will be prevented by the pawl and ratchet arrangement 640.

The remainder of the straps 600 can be adjusted as previously described, and the patient can then be moved by the roller 342. The roller can easily be removed by rotating the pawl in a non-engaging position as shown in phantom in FIG. 34 or by loosening all of the straps 600 from the sheet, moving the roller away from the C-shaped surface 356 and then removing the roller 342 from the bearing units 344 through the open ended slots.

In some hospital beds, it is not feasible to fasten the bearing units 344 to the headboard or baseboard. In that case, the bearing units 344 can be removably secured to the bed frame through tubes 700 shown in FIGS. 37–39. In many cases, the tubes 700 are already provided adjacent the four corners of the bed frame and are used as intravenous (IV) tube holders which can be used to support posts that hold bags supplying intravenous (IV) drugs to a patient.

Figure 39:
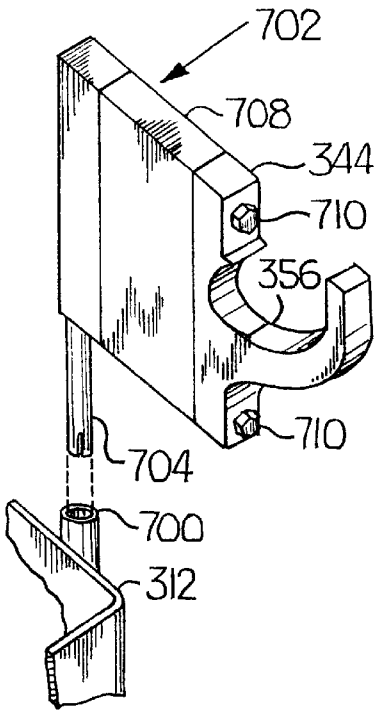
FIG. 39 is a top perspective fragmentary view showing the bearing holder and the post shown in FIG. 38.
Figure 38:
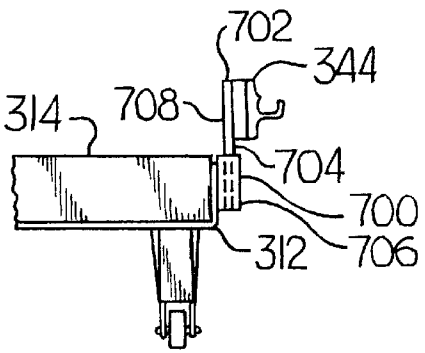
FIG. 38 is a side view showing the bed shown in FIG. 37 with a bearing holder and a post made in accordance with the present invention.

As shown in FIGS. 38 and 39 of the drawings, a bearing holder 702 is provided and includes an elongated post 704 adapted to be received by the tube 700. The post 704 includes a rectangular upper portion and a lower cylindrical portion having a slot defined at a lower end thereof adapted to engage a pin 706 positioned in each of the tubes 700. A plastic spacer block 708 is secured to the upper portion of the post 704. The bearing unit 344 (as previously described) is then secured to the post 704 and spacer block 708 by bolts 710. Preferably, the post is made of high strength steel, such as "4140" tool steel.

In operation, two bearing holders 702 are positioned on opposite ends of one side of the bed 310 in tubes 700 so that the bearing assemblies 344 face away from the bed and the post slots engage respective pins 706. The roller ends 343*a* and 343*b* are secured to the respective bearing assemblies 344 and the straps 400 are secured to the sheet as previously described. Similar tubes 700 can be provided on a gurney and hence, the roller 342 and bearing holders 702 can be removably attached to the gurney, in lieu of the bed, in the same manner described. After the patient is moved, the roller 342 and the bearing holders 702 are preferably removed from the bed.

In an alternative arrangement, the roller can be permanently secured to the bearing assemblies 344 and bearing holders 702 so that the whole assembly can be removably received by the tubes 700.

Figure 40:
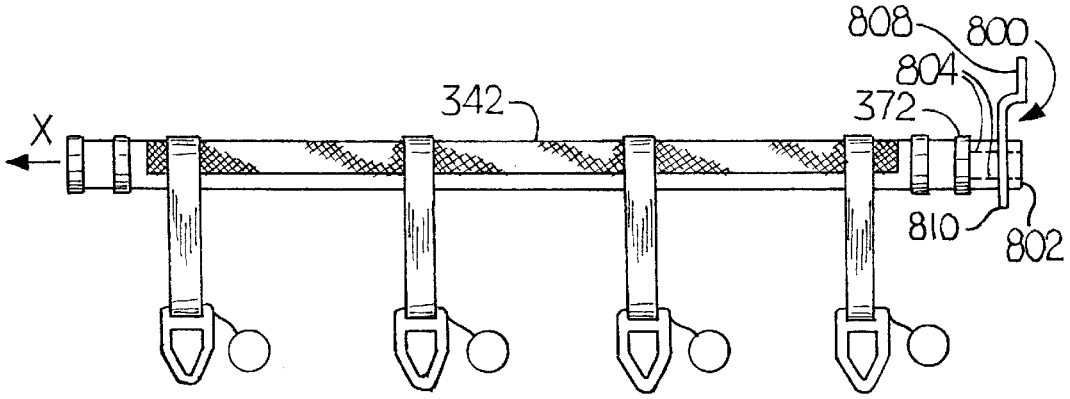
FIG. 40 is a plan view of a roller assembly similar to that as shown in FIG. 22 with a different handle.

FIG. 40 shows another embodiment of a roller similar to roller 342 with the exception of the handle 384. A driving arrangement 800 is secured to collar member 372, which is similar to the driving arrangement disclosed in U.S. Pat. No. 5,340,266. Driving arrangement 800 includes a substantially cylindrical coupling 802 having an end fixedly secured to collar member 372. Aligned elongated rectangular slots 804 pass through the side of the coupling 802. A crank handle 806 having a rectangular cross-section is adapted to be slidably received by the slots 804. An extension 808 of the handle permits a user to rotate the handle 806 about the X axis, similar to handle 384. Preferably, the handle 806 is removed from the slots 804 after the patient is moved. Also, the base portion 810 of the handle is adapted to fall out of the slots 804 when the extension 808 is positioned adjacent the floor and no one is holding onto the extension 808. This prevents a bystander from getting hit by the handle 806 when the roller is rotated in a fashion other than rotating the roller by the handle, i.e., pulling a rolled up sheet from the roller to expose the clips to remove the sheet from the straps. Handle 806 can be incorporated with any of the rollers described herein.

Figure 41:
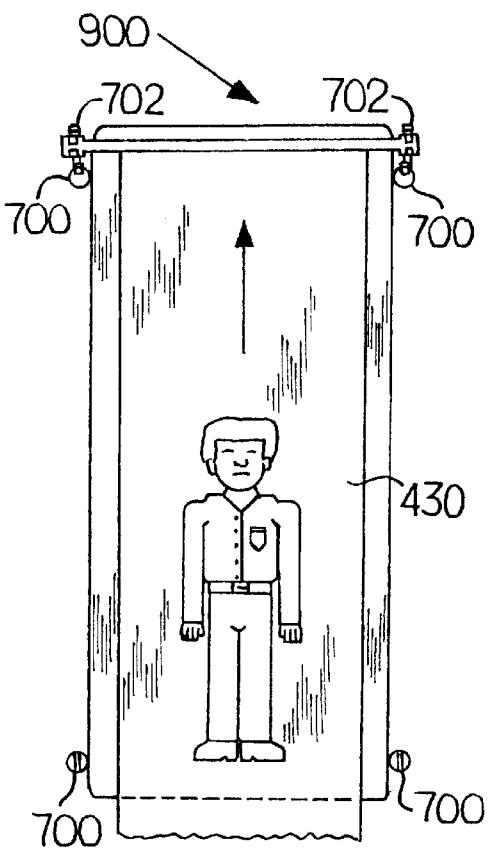
FIG. 41 is a top view of a bed having a conveyor made in accordance with the present invention positioned at the head of the bed.

FIG. 41 shows another embodiment of the present invention where a conveyor 900, similar to any of the conveyors previously shown, is removably secured and positioned adjacent to the head of a bed.

In this manner, the patient can be moved from the foot of the bed toward the head of the bed by wrapping the sheet 430 around the roller of the conveyor 900. Preferably, tubes 700 and bearing holders 702 are provided so that the conveyor can be removed after the patient is moved. Also, in this arrangement, the conveyor 900 can be secured to the foot of the bed to pull the patient toward the foot of the bed. Preferably, the conveyor 900 includes a telescoping member so that its length can be sufficiently changed and adapted to be positioned at the head or foot of the bed, or adjacent one of the sides of the bed.

Figure 42:
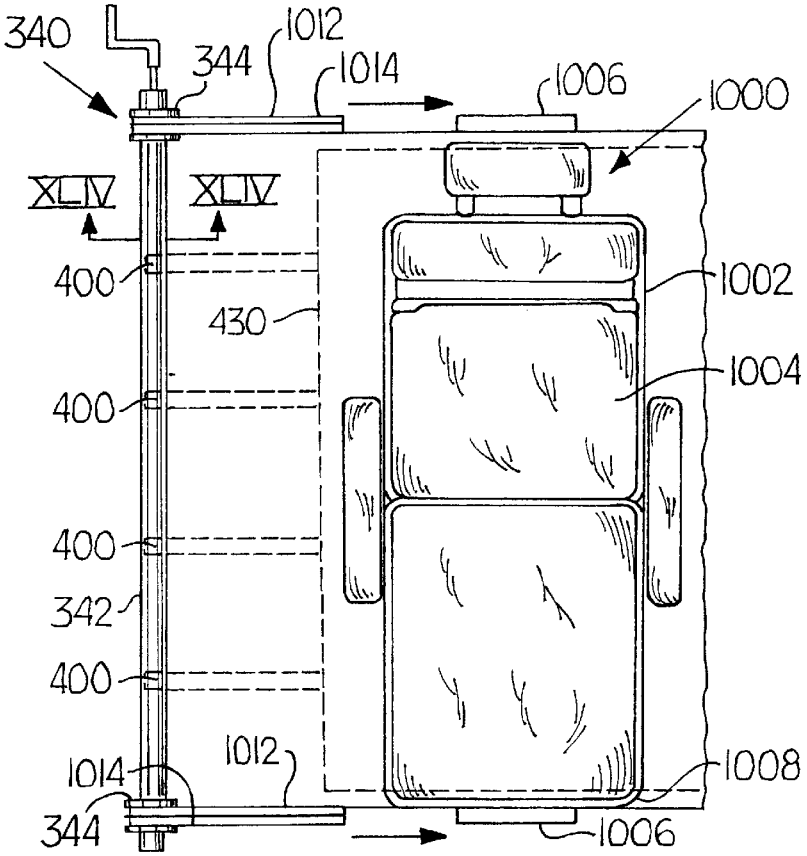
FIG. 42 is an exploded top plan view of another embodiment of the present invention showing a conveyor for use with a gurney that converts into a wheelchair.
Figure 43:
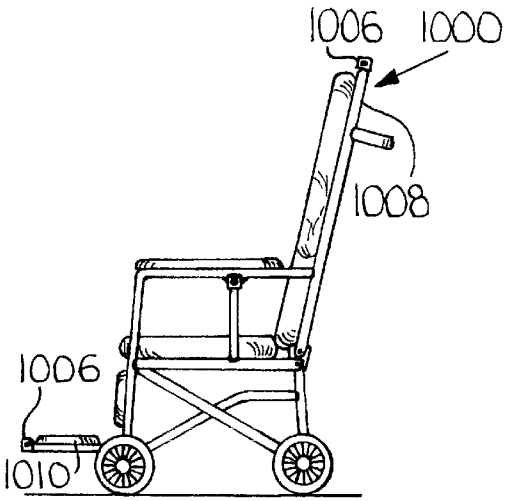
FIG. 43 is a side view of the gurney shown in FIG. 42 converted into a wheelchair.
Figure 44:
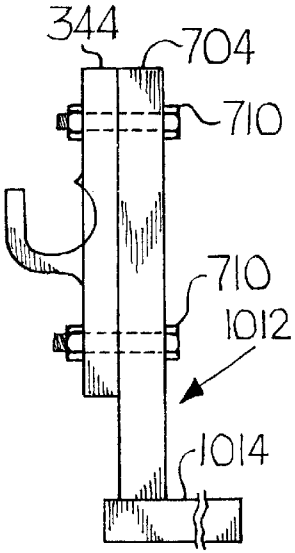
FIG. 44 is a side view of a bearing unit shown in FIG. 42.

FIGS. 42–44 show another embodiment of the invention and relate to gurneys that convert into wheelchairs. Presently, Guardian Products, Inc., located at 12800 Wentworth Street, Arieta, Calif. 91331, sells a wheelchair that converts into a gurney under the trademark Medi-Chair™. Such convertible gurneys are well-known in the art. FIGS. 42 and 43 show a convertible gurney 1000, such as the Medi-Chair™ convertible gurney Model Nos. 020-0205 and 020-0206A, where the convertible gurney 1000 is in the gurney state (FIG. 42) and the convertible gurney is in the wheelchair state (FIG. 43). The convertible gurney 1000 includes a frame 1002 and a patient supporting member 1004 attached to the frame 1002. Hollow tube holders 1006 are secured, preferably by bolting or welding, to the frame 1002 adjacent a head section 1008 and foot section 1010 of the convertible gurney 1000.

As shown in FIGS. 42 and 44 of the drawings, two bearing holders 1012 are provided, wherein each includes a horizontal post 1014. Posts 1014 are adapted to be removably received by respective tube holders 1006. Bearing holder 1012 is similar to bearing holder 702 in that the bearing unit 344 is attached to a vertical post 708 by fasteners 710. In the case of bearing holder 1012, vertical post 704 is attached to horizontal post 1014 as shown in FIG. 44 of the drawings.

Moving a patient from a bed to the convertible gurney 1000 is explained as follows. First, the convertible gurney 1000 is converted into the gurney state as shown in FIG. 42 and moved toward a bed when a patient is lying on a sheet. Bearing holders 1012 are then slidably and removably received into the tube holders 1006 at the head section 1008 and the foot section 1010, so that the bearing units 344 are positioned adjacent the side of the gurney furthest from the bed. The roller 342 is then received by the bearing units 344 and the sheet 430 shown in phantom is removably secured thereto by straps 400 shown in phantom as previously described.

The handle of the conveyor 340 is then rotated and the patient is moved onto the convertible gurney 1000 so that the patient's head is preferably near the gurney's head section 1008 and the patient's feet are adjacent the foot section 1010. The sheet is then removed from the roller 342 and the conveyor 340 and bearing holders 1012 are removed from the convertible gurney 1000. End portions of the sheet can then be tucked under the patient and the convertible gurney 1000 can be converted into a wheelchair as shown in FIG. 43. To return the patient to the bed, the convertible gurney 1000 is converted from a wheelchair to a gurney; and the above method is then reversed to move the patient from the convertible gurney 1000 to a bed, with the exception of securing the conveyor 340 to the bed at the side furthest from the gurney 1000 in a manner similar to moving a patient from a gurney to a bed as previously described herein.

The methods previously described attach the straps to the sheet or membrane using individual clips and individual straps. When deploying the straps from the rolled condition, it is possible that the straps will unroll unevenly because it is not possible for one person to grab all four or more clips to pull the straps off the roller at the same time. Consequently, the straps that are grabbed pull out while the ones not grabbed remain in a rolled condition and simply rotate with the roller. In other words, the straps get out of phase and require the operator to take time to rectify the situation by unrolling the rolled straps until they are the same length as the ones deployed by grabbing and pulling them out. This extra time can be eliminated by integrating all of the clips (usually three) attached to the roller into one integral clip arrangement 1100. This allows the operator to grab the center of the clip arrangement 1100 with one hand and pull a number of straps at one time.

Figure 45:
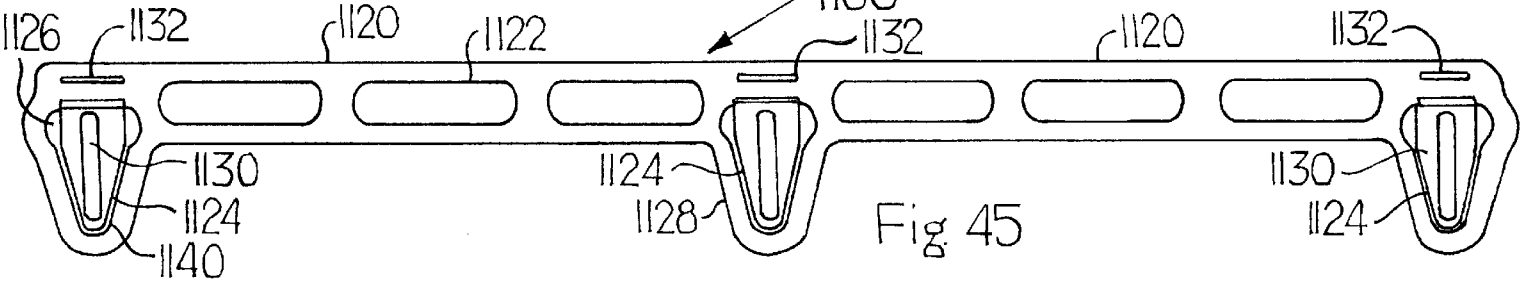
FIG. 45 is a top view of a clip arrangement made in accordance with the present invention.

Referring specifically to FIG. 45, the clip arrangement 1100 includes three clip portions 1110 equally spaced along the length of the clip arrangement 1100. The clip arrangement 1100 includes two integral sections 1120 and is typically made from plastic. A plurality of holes 1122 are defined to lighten the weight of the clip arrangement 1100. Each clip portion 1110 includes a thin plastic membrane 1124 attached by an integrally formed hinge 1126 to a body 1128 of the clip portion 1110. A guide slot 1130 is defined in the membrane 1124. Strap slots 1132 are defined in the clip portions 1110 through which straps 400 pass.

Figure 46:
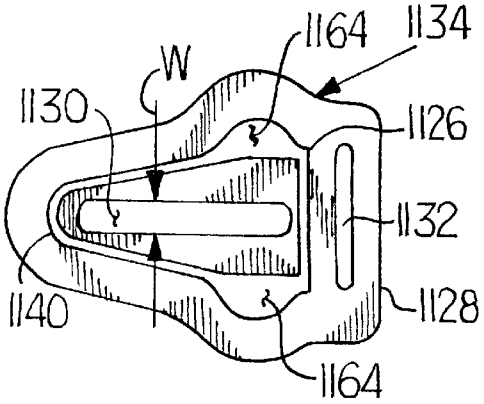
FIG. 46 is a top view of another embodiment of a clip made in accordance with the present invention.
Figure 47:
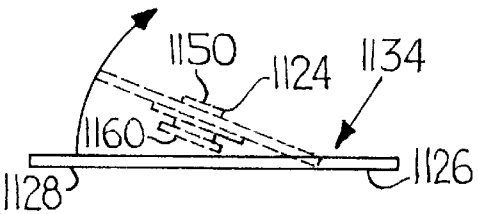
FIG. 47 is a side view of the clip shown in FIG. 46.

Alternatively, the clip portion 1110 can be made as an individual clip 1134 as shown in FIGS. 46 and 47. Like reference numerals are used for like elements. As can be seen in FIG. 47, the hinge 1126 is a living hinge and should be thin enough to permit the membrane 1124 to flex or pivot about the hinge relative to said body 1128. Preferably, the clips 1134 are made of a plastic such as a high density polyethylene. The clips 1134 can be used in conjunction with clip arrangement 1100 in such arrangements as the modified roller shown in FIGS. 27–32, where the clip arrangement 1100 is used with the roller 342 and the clip 1134 is used with the telescopic arrangement 500. This allows the operator to grab the center of the clip arrangement 1100 with one hand and pull out a number of straps at a time. The other hand of the operator can then be used to pull the one remaining clip 1134, which is secured to telescopic arrangement 500. Thus, with the roller placed in the bearings mounted to the bed, it is possible for one person to pull out all the straps at the same time and to the same length in one action.

Figures 48A, 48B, 49, 50A, 50B, 50C, 51:
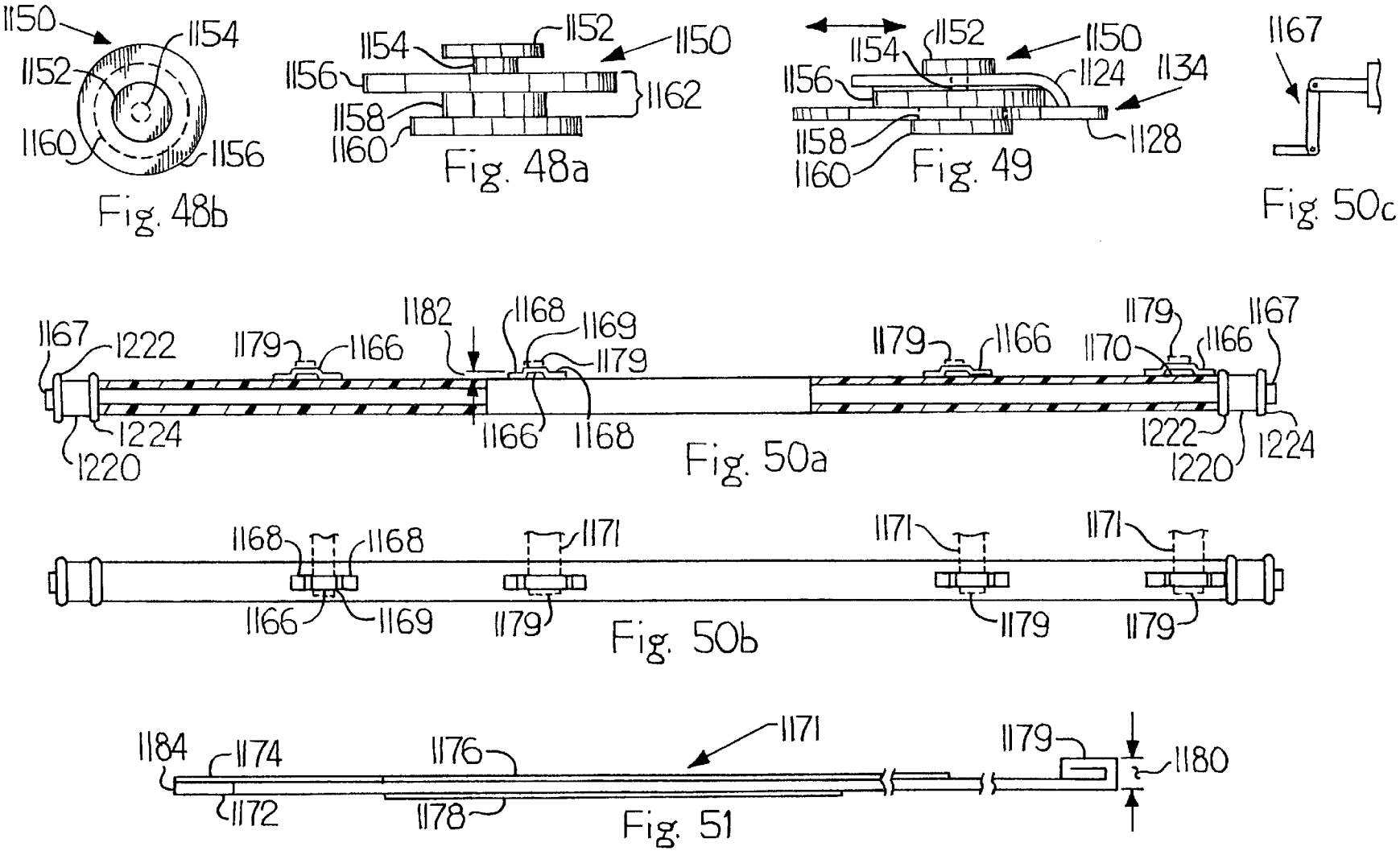
FIG. 48A is a side view of another plug made in accordance with the present invention.
FIG. 48B is a top view of the plug shown in FIG. 48.
FIG. 49 is a side view showing the plug shown in FIGS. 48A and 48B engaged with the clip shown in FIGS. 46 and 47.
FIG. 50A is a side view, partially in section, of another embodiment of a roller made in accordance with the present invention.
FIG. 50B is a top view of the roller shown in FIG. 50A.
FIG. 50C is a side view of a collapsible handle used with the roller shown in FIGS. 50A and 50B.
FIG. 51 is a side view of a belt for use with the roller shown in FIGS. 50A and 50B.

As shown in FIGS. 48A and 48B, a rubber plug 1150 is provided and is similar to plugs 212 and 420. Plug 1150 includes five circular discs 1152, 1154, 1156, 1158 and 1160 integrally connected to each other. The diameter of disc 1156 is greater than the diameter of disc 1160, which is greater than the diameters of discs 1152 and 1158, which are greater than the diameter of disc 1154. Disc 1154 is slidably received by slot 1130 in the membrane 1124. The width "w" of slot 1130 is slightly greater than the diameter of disc 1154. Discs 1152 and 1156 are positioned on opposite sides of membrane 1124, a portion of which is positioned therebetween. The diameters of discs 1152 and 1156 are greater than the width "w" of slot 1130. The membrane 1124 is positioned between discs 1156 and 1152. The thickness of disc 1154 is greater than the thickness of the membrane 1124. A portion of the body 1128 is adapted to be positioned between discs 1156 and 1158. Discs 1156, 1158 and 1160 form a plug subassembly 1162 which has the same dimensions as plug member 420. As shown in FIG. 49, plug subassembly 1162 interacts with the body 1128 in the same manner as plug member 420 interacts with clip 418.

As also can be seen in FIG. 49, the membrane 1124 is flexible so that the plug 1150 can be moved along the slot 1130 toward the tip of the clip such that a bed sheet can be sandwiched between the body 1128 and plug subassembly 1162. Moving the plug away from the tip toward slot 1132 will permit the disc 1160 to cause the plug subassembly 1162 to disengage the sheet and permit the disc 1160 to pass through the recesses 1164, as shown in phantom in FIG. 47. The arrangement between the membrane 1124 and discs 1152, 1154 and 1156 prevents the plug 1150 from being misplaced when the plug is not engaged with the body 1128 and permits easy alignment of the sheet, the body 1128 and the plug 1150.

As previously described, the rubber plugs 212 and 420 are tethered to the plastic clips 202 and 418, respectively. This arrangement requires the operator to locate the plug, orient the plug properly and then insert the plug into the clip. Clip arrangement 1100 and clip 1134 keep the plug 1150 in close proximity to the clip arrangement 1100 and the clip 1134 and always in the correct orientation. This saves time and allows the operator to clip the sheet using only one hand. The slot 1130 is long enough to allow the plug 1150 to slide away from the vee 1140 in the body 1128 far enough to allow a sheet to be inserted between the plug 1150 and the clip body 1128. The slot 1130 is long enough to allow the plug to be slid into the vee 1140, thus capturing the sheet. The general configuration is such that once the sheet is positioned between the plug 1150 and the clip body 1128, the operator can simply grab the plug 1150 by putting a thumb on the top of it and the sheet and putting the middle finger on the lower-most disc of the plug 1150, then sliding the plug 1150 (with the sheet captured between the thumb and the plug 1150) away from the bed unit. The plug/sheet fits into the hole defined by the clip body 1128 that includes recesses 1164. The plug/sheet is then slid towards the bed until it jams into the vee 1140 of the clip body 1128.

FIGS. 50A–50B show a modified hollow graphite roller 1165 similar to roller 420. A plurality of metal stop clips or bridge-like strap anchor points 1166 replace the Velcro® strip 392 of roller 420. As shown in FIGS. 50A–50C, two segmented handles 1167, similar to segmented handles 501, are slidably received on opposite ends of the roller 1165. The stop clips 1166 are substantially metal brackets having two end portions 1168 and a raised middle portion 1169. A passageway 1170 is defined between the raised middle portion 1169 and a portion of the outer surface of the roller 1165. End portions 1168 are secured to the roller 1165 either by mechanical fasteners or by an adhesive.

FIG. 51 shows a flexible strap 1171 similar to strap 600 and includes a flexible material 1172, such as a woven polypropylene, woven polyethylene or cotton. Preferably, the straps 1171 should be as short as possible to reduce the propensity to tangle. Velcro® hook fastener material 1174 is attached to a forward end of the belt, which is adapted to pass through slot 1132 of the clip 1134 or clip portion 1110. Velcro® loop fastener material 1176 is attached to a middle portion of the flexible material on the same side as the material 1174. The length of the strap 1171 and clip 1134 or clip arrangement 1100 can be modified after the strap first end is passed through the clip strap slots 1132 and the hook fastener material 1174 is connected to the loop fastener material 1176, such as shown in FIGS. 34 and 35. Velcro® hook material 1178 is secured to a middle portion of the flexible material 1172 of strap 1171 on an opposite side of the flexible material 1172 of strap 1171. End 1179 is built up by rolling over several layers of flexible material 1172 of strap 1171 and securing the layers in place by, for example, sewing the layers together. The height 1180 of the end 1179 is greater than the height 1182 of the passageway 1170. In this manner, a forward end 1184 of each of the straps 1171 is passed through the passageway 1170 and the strap 1171 is pulled until end 1179 is stopped by the respective stop clip 1166 as shown in phantom in FIGS. 50A and 50B. In other words, the straps 1171 are fed through stop clips 1166 from end 1184 and are stopped at end 1179 by a multiplicity of strap layers formed by folding the strap on itself three or four times and then sewing the multiple layers together. This forms a positive stop for the strap and eliminates the two or more wraps required when the strap is attached to the roller with Velcro® as previously described. The straps 1171 can be removed from the roller 1165 by reversing the above procedures. Other types of stopping arrangements can be utilized in place of the folded-over strap. One such example is a plastic block having a height 1180 or having a width greater than the width of the passageway and secured to the end 1179 of the strap.

Figure 53:
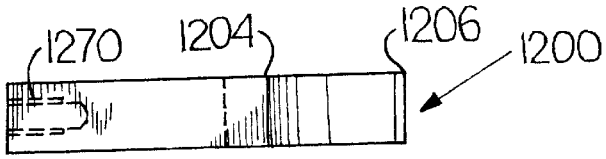
FIG. 53 is a top view of a bearing shown in FIG. 52.
Figure 52:
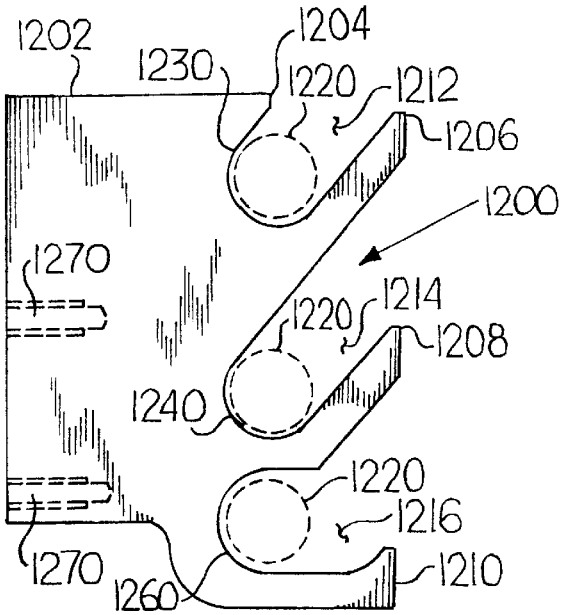
FIG. 52 is a side view of a bearing made in accordance with the present invention.

FIGS. 52 and 53 show a bearing unit 1200 similar to bearing unit 344 and which can be used as a replacement therefor. Bearing unit 1200 includes a body 1202 and legs 1204, 1206, 1208 and 1210, which define respective recesses 1212, 1214 and 1216. Journal portions 1220 of roller 1165 are adapted to be received in bearing slots or recesses 1212, 1214 or 1216 depending on the bed style. Collar members 1222 and 1224 of roller 1165 shown in FIG. 50A are spaced apart a distance greater than the thickness of the bearing unit 1200. The respective bearing units 1200 are removably positioned between collars 1222 and 1224. In operation, the journal portions 1220 located on opposite ends of the roller 1165 are received by respective slots 1212, 1214 or 1216. The sheet is attached to the roller as previously described. Rotation of the roller 1165 causes the journals 1220 to be pulled against respective C-shaped surfaces 1230, 1240 or 1260 during winding of the roller 1165. Screw holes 1270 are provided so that the bearing unit can be secured to the post 704.

Figure 37:
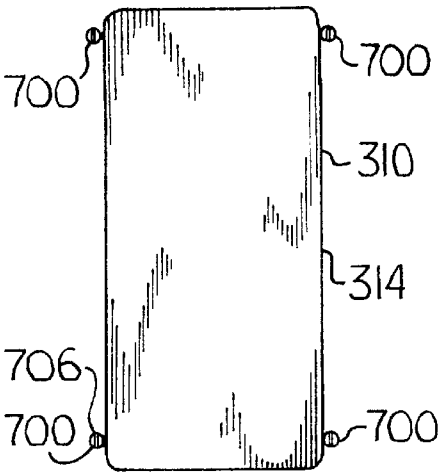
FIG. 37 is a top view of a bed having bearing. holder tubes positioned adjacent the corners of the bed.

A large number of hospital beds have a common feature, namely, built-in intravenous pole support sockets. On many of the beds, the sockets have a common internal diameter which will accept a ¾ inch diameter rod. In most cases, the socket is strong enough to take the stresses produced by transferring patients using the patient transport system; therefore, the socket, which is shown in FIGS. 37–39, is a convenient way to support the patient transfer system. Although the diameter of the socket is consistent, the lateral and vertical positions of the socket are not consistent. However, in most instances, it is believed that three bearing vertical positions will suffice for a whole subgroup. Bearing unit 1200 provides the most common vertical positions. Bearing unit 1200 provides a series of heights that can be selected simply by inserting the journal 1220 of the roller into the bearing slots or recesses 1212, 1214 or 1216 of choice to suit the bed in question. Although FIGS. 52 and 53 show a bearing unit having only three positions which vary in height, additional recesses can be provided by making the bearing body longer or only two positions can be provided. The lateral position of the recesses can also be varied.

Figure 54:
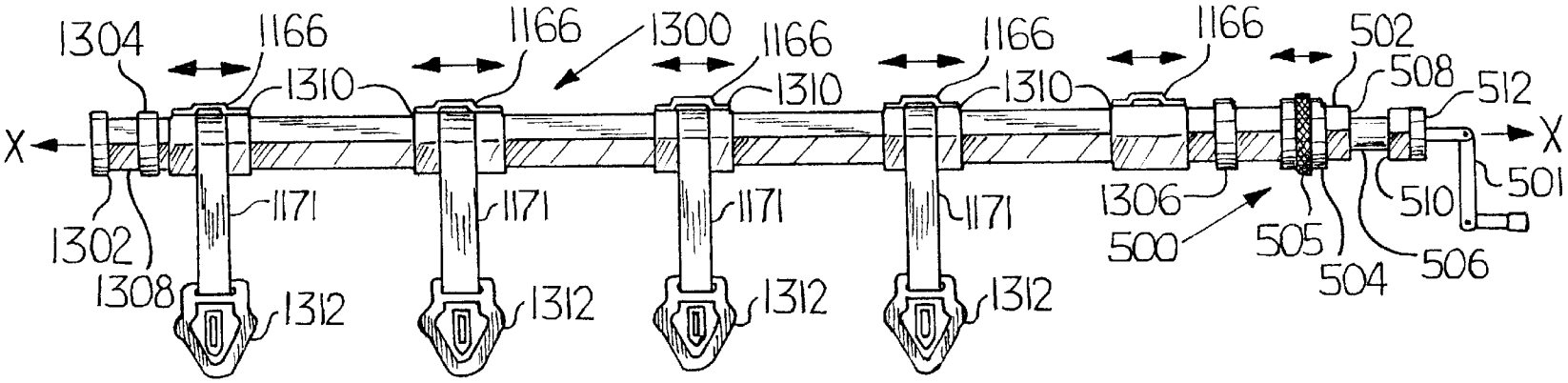
FIG. 54 is a plan view of another embodiment of a roller assembly made in accordance with the present invention.

FIG. 54 shows another embodiment of the present invention similar to the embodiment shown in FIGS. 27–32. Like reference numerals will be used for like elements. A roller 1300 is provided that has a substantially hexagonal cross section and collars 1302, 1304 and 1306 which are provided on ends of the roller 1300. A cylindrical journal portion 1308 is defined between the collars 1302 and 1304. A telescopic arrangement is provided at one end of the roller 1300 and is the same as previously described telescopic arrangement 500, wherein like reference numerals refer to like elements. The telescopic member 500 includes a segmented handle 501, a hexagonally shaped telescoping member 502 and a sleeve 504. A hexagonally shaped hole is defined in the roller 1300 at one end thereof and slidably receives the telescoping member 502. The sleeve 504 has a hexagonally shaped bore and slidably receives the telescoping member 502 therethrough. A Velcro® strip 505 is attached to the sleeve 504. A recessed cylindrical journal portion 506 is defined at an end of the telescoping member 502. Guide surfaces 508 and 510 are defined by the telescoping member 502 adjacent the recessed journal portion 506. An end cap 512 is attached to an end of the telescoping member 502 and coacts with the handle 501.

A plurality of roller sleeves 1310 is slidably received on the roller 1300. Each of the roller sleeves 1310 is hollow and define a hexagonal passageway passing therethrough. Preferably, the passageways of the roller sleeves 1310 have the same geometric shape as the cross-sectional shape of the roller. Each of the roller sleeves 1310 includes a stop clip 1166 which was previously described. Straps 1171 are provided and coact with the respective stop clips 1166 as previously described. Alternatively, modified straps 1179 can be provided that are similar to straps 1171, except that in lieu of the built up ends 1179, the modified ends 1179 of the straps 1171 are provided with a Velcro® hook and loop fastening arrangement as previously described that can be passed through the stop clips 1166 and secured to the respective straps to form a securement loop around the stop clip middle portions 1169, whereby the hook fastener portion contacts the loop fastener portion forming a loop. Clips 1312 are removably secured to the straps in a similar manner as previously described clips 1134. Alternatively, using the modified strap 1179, the length of the straps can be adjusted from both ends of the modified straps 1179. In this manner, the modified straps 1179 can be adjusted to become taut at the ends of the modified straps 1179 adjacent the stop clips 1166. As the straps are rotated about the sleeves 1310, it may be necessary to readjust the length or tautness of one or more of the modified straps 1179. This can be accomplished at the strap end adjacent the clip 1312, such as is done with strap 600. By the length of the strap, it is meant as the distance represented by reference numeral 1350, which is the distance between the respective sleeve 1310 and the clip 1312.

The roller 1300 is secured to a bed or gurney in a similar manner as the previously described rollers. Once the roller 1300 is in place, the straps 1171 can be moved and positioned along the longitudinal axis X that passes through the roller 1300. Also, a strap can be secured to sleeve 504 as previously described. The sheet is then attached to the clips 1312 by the previously described plugs in the previously described manner. The straps 1171 and the strap secured to sleeve 504 can then be retightened so that they are taut. The roller 1300 is then rotated via handle 501 and during rotation, the sleeves 1310 and 504 can move along the longitudinal axis X as well as rotate about the longitudinal axis X. The sleeves 1310 and 504 are caused to rotate about the longitudinal axis X by the hexagonal surfaces of the roller 1300 and the telescoping member 502 coacting with or drivingly engaged with the inner surfaces of the sleeves 1310 and 504, respectively. It has been found that improved results are obtained by permitting all of the straps 1171 and the strap secured to sleeve 504 to move along the longitudinal axis X during rotation of the roller 1300.

Figure 56:
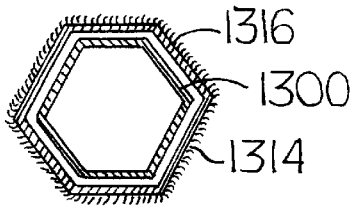
FIG. 56 is a section taken along lines LVI—LVI of the rollers shown in FIG. 55.
Figure 55:
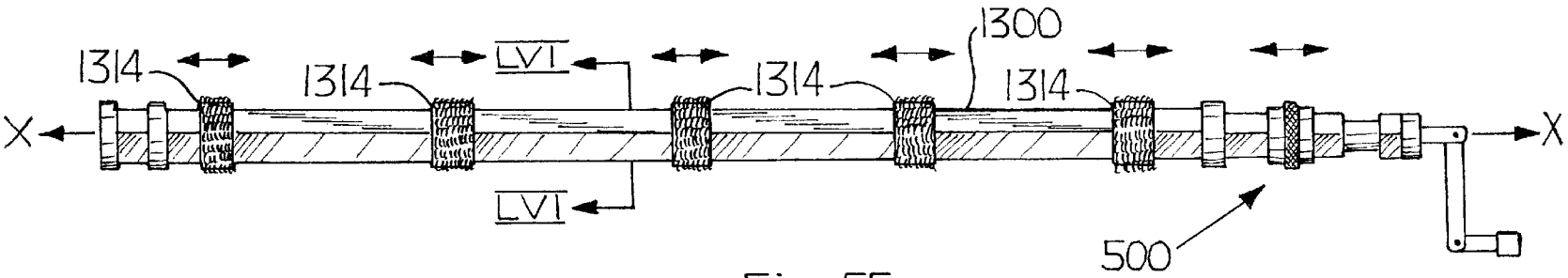
FIG. 55 is a plan view of another embodiment of a roller assembly made in accordance with the present invention.

FIGS. 55–56 show the roller 1300 having different sleeves 1314. The sleeves 1314 are slidably received by the roller 1300 and are similar to the sleeves 1310 except Velcro® strips 1316 are attached to outer surfaces of the sleeves 1314 in lieu of the stop clips 1166 and straps 600 are removably attached to the roller 1300 in lieu of straps 1171.

Figure 57:
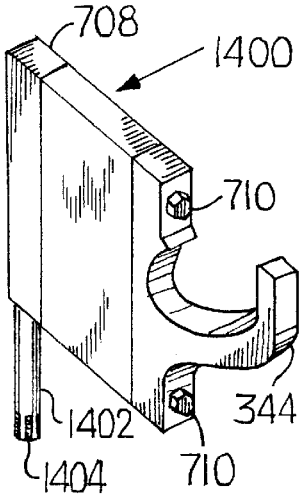
FIG. 57 is a top perspective view showing a bearing holder.
Figure 58:
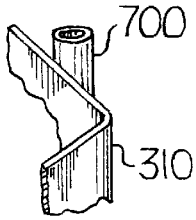
FIG. 58 is a top perspective view of a tube and bed arrangement adapted to receive the bearing holder shown in FIG. 57.

FIG. 57 shows a bearing holder 1400 similar to the bearing holder 702 except for the post 704. Like reference numerals represent like elements. The bearing holder 1400 includes an elongated post 1402 adapted to be received by the tube 700 (shown in FIGS. 37–39 and 58). The post 1402 includes a rectangular upper portion and a cruciform shape slot 1404 defined by four slots spaced 90° apart formed at a lower end of the post 1402. The cruciform shaped slot 1404 is adapted to receive a pin positioned in each of the tubes so that the post 1402 engages the pin. A plastic spacer block 708 is secured to the upper portion of the post 1402. The bearing unit 344 (as previously described) is then secured to the post 1402 and plastic spacer block 708 by bolts 710.

Figure 59:
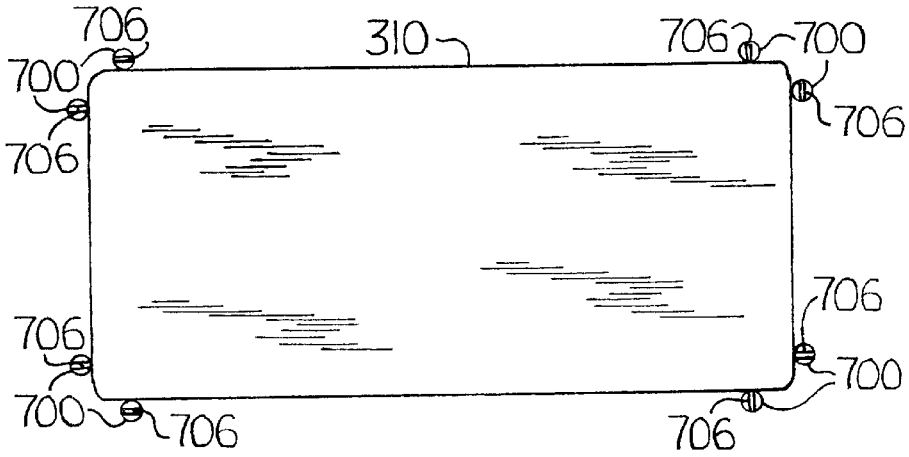
FIG. 59 is a top perspective view of a bed having a tube and pin arrangement adapted to receive the bearing holder shown in FIG. 57.
Figure 60:
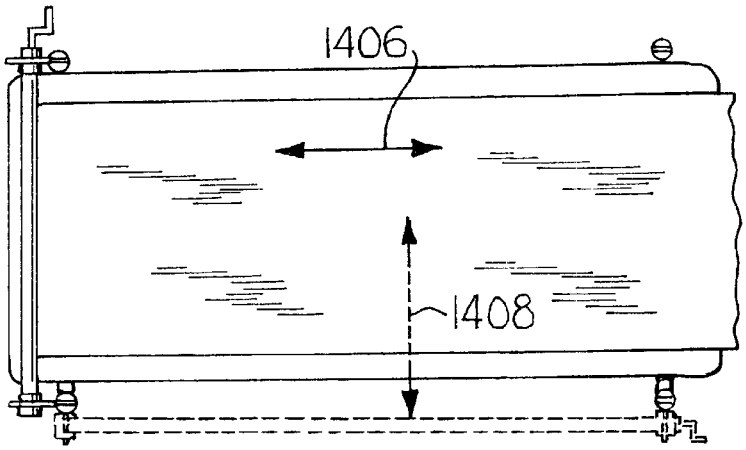
FIG. 60 is a top view of a bed having a conveyor made in accordance with the present invention.

FIG. 59 shows a bed 310 having eight tubes 700 secured thereto and pins 706 are provided in the tubes 700. A pair of tubes 700 is positioned on each side of the bed 310, at the head of the bed 310 and at the foot of the bed 310. This arrangement permits a pair of bearing holders 1400 to be received by the tubes 700, wherein the pins 706 coact with the cruciform shaped slot 1404. One of the previously described telescopic rollers can be received by the bearing units 344 to either pull a patient in a longitudinal direction 1406 or in a lateral direction 1408 across the bed 310 as shown in FIG. 60 depending upon which tubes 700 receive the bearing holders 1400. Alternatively, this arrangement can support two different sized rollers, one adapted to be received by the tubes 700 positioned at the head and the foot of the bed 310 and the other adapted to be received by the tubes 700 positioned along the sides of the bed 310. An advantage of the cruciform shaped slot 1404 is that the pins 706 can be oriented in the same direction as shown in FIG. 59 or can be positioned perpendicularly to each other and still properly engage with the post 1402 so that a roller can be received by the bearing units 344. Movement of a patient in the longitudinal direction 1406 is advantageous when a patient slides toward the head or the foot of the bed and needs to be repositioned. The roller would be positioned at the head of the bed to move the patient toward the head of the bed and the roller would be positioned at the foot of the bed to move the patient toward the foot of the bed.

Figure 61:
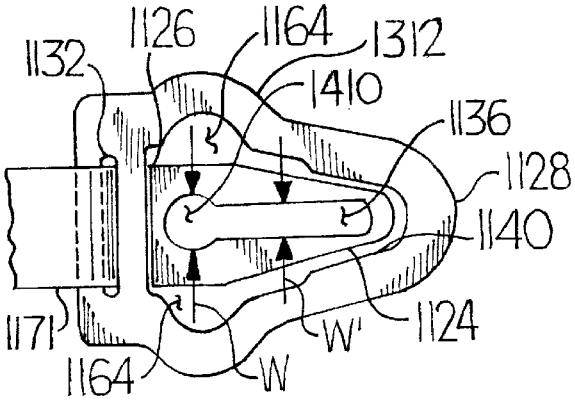
FIG. 61 is a top view of another embodiment of a clip attached to a portion of a belt made in accordance with the present invention.

FIG. 61 shows the clip 1312 shown in FIG. 54. The clip 1312 is similar to the previously described clip 1134, where like reference numerals represent like elements. The clip 1312 includes a plastic membrane 1124 attached to an integrally formed hinge 1126 on a body 1128. A guide slot 1130 is defined in the membrane 1124. A strap slot 1132 is defined in the body 1128 through which a strap 1171 passes. A vee 1140 Is defined in the body 1128. Recesses 1164 are defined by the body 1128. The guide slot 1130 has an elongated width portion 1410 having a width W at an end opposite the vee 1140. The width W is wider than the width W' of the remainder of the guide slot 1130.

Figure 62:
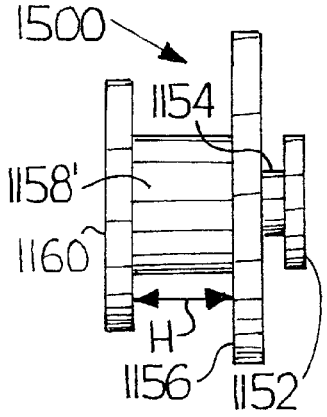
FIG. 62 is a side view of another plug made in accordance with the present invention.
Figure 63:
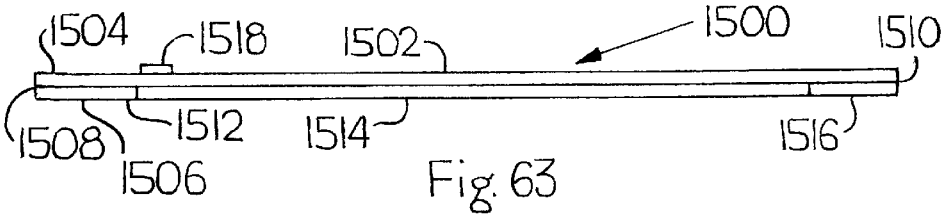
FIG. 63 is a side elevational view of a belt for use with a roller shown in FIG. 54 made in accordance with the present invention.
Figure 64:
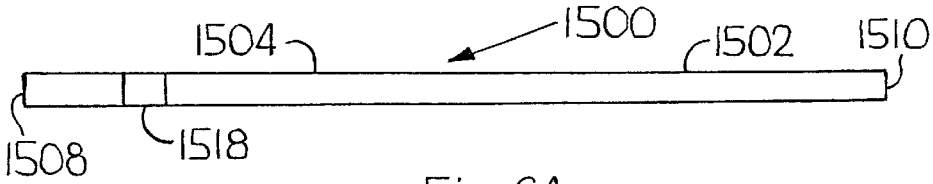
FIG. 64 is a top plan view of the belt shown in FIG. 63.
Figure 65:
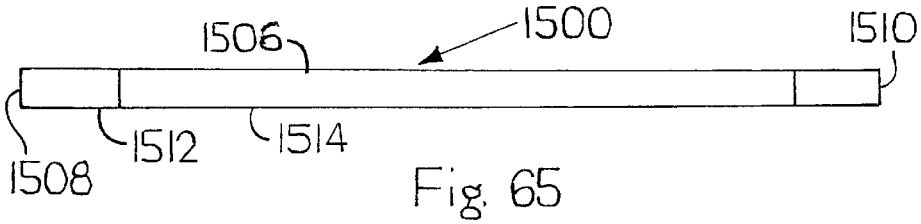
FIG. 65 is a bottom plan view of the belt shown in FIG. 63.

FIG. 62 shows a plug 1500 similar to the rubber plug 1150. The plug includes five circular discs which are similar to the circular discs 1152, 1154, 1156, 1158' and 1160, with like reference numerals representing like elements. The only difference between the rubber plug 1500 and the rubber plug 1150 is that the height H of the disc 1158' is greater than the height of disc 1158 so that thicker sheets can be accommodated. The rubber plug 1500 coacts with the clip 1312 in the same manner that the rubber plug 1150 coacts with the clip 1134 (as previously described) except the rubber plug 1500 can be removed from membrane 1124 by passing the circular disc 1152 through the enlarged width portion of the slot 1130. The width W of the enlarged portion 1410 of the slot 1130 is greater than the diameter of the circular disc 1152 while the width W' of the remainder of the slot 1130 is less than the diameter of the disc 1152 so that for that portion of the slot 1130 the rubber plug 1150 is slidably received by the slot 1130.

FIGS. 63–67 show a flexible belt or strap 1500 made in accordance with the present invention. The strap 1500 includes an elongated strap section 1502. The strap 1500 includes a first side 1504, a second side 1506, a first end 1508 and a second end 1510. The second side 1506 includes a hook fastener portion 1512, such as a Velcro® hook fastener positioned adjacent to the first end 1508, an intermediate loop fastener portion 1514, such as a Velcro® loop fastener positioned adjacent to the hook fastener portion 1512 and another hook fastener portion 1516, such as a Velcro® hook fastener positioned adjacent to the loop fastener portion 1514 and the second end 1510. The first side 1504 of the strap 1500 includes a hook fastener portion 1518, such as a Velcro® hook fastener positioned a distance from the first end 1508. The hook fastener portion 1512, the intermediate loop fastener portion 1514, the hook fastener portion 1516 and the hook fastener portion 1518 are attached to the elongated strap section 1502.

Figure 66:
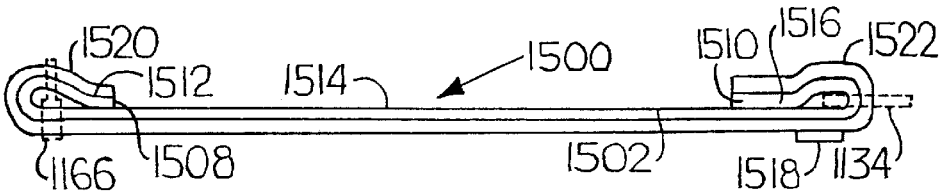
FIG. 66 is a side elevational view of the belt shown in FIG. 63 in an assembled position.

Referring to FIG. 66, in operation, the first end 1508 can be passed through and received by the stop clip 1166 and the second end 1510 can be passed through and received by the clip 1134. Clip 1134 and stop clip 1166 are shown in phantom in FIG. 66. As can be seen, the first end 1508 is passed through stop clip 1166 and a first loop 1520 is formed wherein the hook fastener portion 1512 is removably secured to the loop fastener portion 1514. Likewise, the second end 1510 is passed through the clip 1134 forming a second loop 1522 whereby the hook fastener portion 1516 is removably secured to the loop fastener portion 1514.

Figure 67:
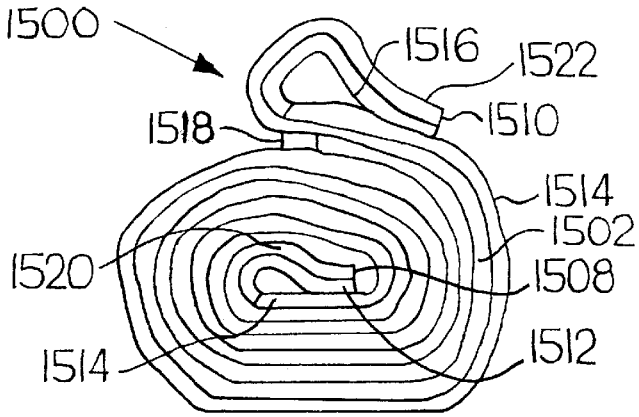
FIG. 67 is a side elevational view of the belt shown in FIG. 66 in a wound state.

When moving a patient from a bed to a gurney or stretcher, the roller 1300 is secured to the stretcher. Preferably, the clips 1134 are first attached to a bed sheet at appropriate points along the bed. The straps 1500 are then attached to the clips 1134 as previously described. A stretcher is then positioned adjacent the bed and the straps are thrown across the stretcher so that they are in easy reach from the opposite side of the stretcher. The free ends of the straps are inserted into the stop clips 1166 of the sleeves 1310 and fastened so as to have equal tension. The patient is then moved by winding the roller 1300. If the patient starts to move out of alignment, the winding is paused in mid-transfer, and the straps 1500 are adjusted at the second end or clip end 1510. Once the straps 1500 are wound around the roller 1300, the hook fastener portion 1518 contacts the loop fastener portion 1514 to maintain the strap 1500 in a wound state, as shown in FIG. 67. The hook fastener portion 1518 is removably secured to the loop fastener portion 1514. This arrangement prevents unrolling of the straps 1500. This process can also be used for moving a patient from the stretcher to a bed.

Other types of removable fasteners can be used in lieu of the hook and loop type Velcro® fasteners described. Alternatively, the above-described loon fasteners and hook fasteners can be substituted for one another.

Further, we have found that preferably for a standard sheet, the thickness of disc 1158 which is defined by the spacing between discs 1156 and 1160 should be on the order of 0.4 inches–0.5 inches, when used with a body 1128 having a thickness of 0.125 inches.

Having described the presently preferred embodiments of the invention, it is to be understood that it may be otherwise embodied within the scope of the appended claims.

I claim:

1. An apparatus for transporting a patient comprising:

a) a base;

b) a patient supporting member attached to said base;

c) a conveyor removably secured to said base, wherein said conveyor includes a roller extending in a longitudinal direction having a plurality of sleeves slidably received on said roller and movable in the longitudinal direction;

d) a sheet having a first end and a second end, said first end attached to said conveyor, wherein said sheet is adapted to be positioned onto said patient supporting member;

e) a plurality of flexible straps each having two ends, one end of each of said straps attached to a respective one of said sleeves and the other end of each of said straps releasably attached to said sheet, wherein each of said flexible straps is releasably attached to said sleeves and each of said strap's length is adjustable at both of said ends of said straps, and wherein each of said flexible straps includes a first side and a second side, a first end and a second end, each of said straps further comprises hook type fasteners positioned adjacent said first end and said second end on said second side of said strap and a loop type fastener positioned between said hook type fasteners on said second side of said strap and a hook type fastener positioned on said first side of said strap wherein said hook type fasteners on said second side of said strap are adapted to form strap loops with said loop type fastener on said second side of said strap; and at least one stop clip secured to one of said sleeves, said stop clip comprising a bracket having a body that defines a passageway, said flexible straps adapted to pass through said passageway.

2. An aparatus for transporting a patient as claimed in claim 1, wherein said conveyor comprises a means for adjusting the length of said roller.

3. An apparatus for transporting a patient as claimed in claim 2, wherein said roller comprises a first longitudinally extending member and a second longitudinally extending member slidably received by said first longitudinally extending member.

4. An apparatus for transporting a patient as claimed in claim 3, wherein said first longitudinally extending member defines a longitudinally extending recess at an end thereof and said second longitudinally extending member is slidably received by said first longitudinally extending member in said recess.

5. An apparatus for transporting a patient as claimed in claim 4, wherein the end of said first longitudinally extending member defines a recess having the same geometric shape as a cross-sectional shape of said second longitudinally extending member.

6. An apparatus for transporting a patient as claimed in claim 4, wherein said roller extends along a first longitudinal axis and said second longitudinally extending member is slidably movable along the first longitudinal axis relative to said first longitudinally extending member and said second longitudinally extending member is drivingly engaged with said first longitudinal member so as to rotate said first longitudinally extending member about said first longitudinal axis when said second longitudinally extending member is rotated about the first longitudinal axis.

7. An apparatus for transporting a patient as claimed in claim 2, further comprising a handle secured to said roller.

8. An apparatus for transporting a patient as claimed in claim 7, wherein said handle is segmented and slidably received by said roller.

9. An apparatus for transporting a patient as claimed in claim 4, wherein at least one of said sleeves is slidably received by said second longitudinally extending member.

10. An apparatus for transporting a patient as claimed in claim 3, wherein at least one of said sleeves is slidably received by said first longitudinally extending member and at least one of said sleeves is slidably received by said second longitudinally extending member.

11. An apparatus for transporting a patient as claimed in claim 1, further comprising a plurality of clips, each of said clips attached to said other end of said flexible straps for removably attaching to said sheet.

12. An apparatus for transporting a patient as claimed in claim 1, wherein each of said flexible straps further comprising means for adjusting the length of said flexible strap.

13. An apparatus for transporting a patient as claimed in claim 1, further comprising means for removably securing said conveyor to said base.

14. An apparatus for transporting a patient as claimed in claim 13, wherein said means for removably securing said conveyor to said base comprises a tube and a post slidably received by said tube, wherein one of said post and said tube is secured to said base and the other of said post and said tube is secured to said conveyor.

15. An apparatus for transporting a patient as claimed in claim 14, wherein a cruciform slot is defined on said post and a pin is secured to said tube, wherein said pin is received by the cruciform slot.

16. An apparatus for transporting a patient as claimed in claim 1, wherein each of said sleeves defines a passageway having the same geometric shape as a cross-sectional shape of said roller.

17. An apparatus for transporting a patient as claimed in claim 1, wherein said roller is drivingly engaged with said sleeves whereby rotation of said roller causes said sleeves to rotate.

18. An apparatus for transporting a patient as claimed in claim 1, further comprising a clip secured to each of said straps, for securing said sheet to said straps, each of said clips comprising a body defining a slot having a converging portion defined by edges of said body, and a membrane attached to said body and positioned within said slot and secured to said body through a living hinge, and a plug received within said slot for sandwiching said sheet between said plug and said edges, wherein said plug includes a first member attached to a second member and a third member attached to said second member, wherein said second member is positioned between said first member and third member, said first member and third member having geometric diameters greater than said second member, a portion of said each of said edges of said body sandwiched between said first and third members and said second member positioned between said portions of said edges of said body, the sheet sandwiched between said first member, second member, third member and said portions of said edges of said body, said plug slidably and removably received by said membrane through a membrane slot having a first width and a second width, said plug further comprising a fourth member attached to said third member and passing through the membrane slot and a fifth member attached to said fourth member, said third member and said fifth member having geometric diameters greater than said fourth member and the first width of said membrane slot, so that a portion of said membrane is positioned between said third member and fifth member and said plug is slidably received by a portion of the membrane slot and is adapted to move relative to said body and said membrane and one of said third member and said fifth member having a geometric diameter less than the second width of the membrane slot so that the plug can be removed from the clip.

19. A device for use with a base, a patient supporting member attached to the base and a sheet having a first end and a second end, said device comprising:

a roller having a first end and a second end extending in a longitudinal direction;

a plurality of sleeves slidably secured to said roller and movable in the longitudinal direction;

two bearing members, each bearing member adapted to be removably and rotatably secured to a respective one of said first end and said second end of said roller;

a plurality of flexible straps each having two ends, one end of each of said straps attached to a respective one of said sleeves and the other end of each of said straps releasably attached to said sheet, wherein each of said flexible straps is releasably attached to said sleeves and each of said strap's length is adjustable at both of said ends of said straps, and wherein each of said flexible straps includes a first side and a second side, a first end and a second end, each of said straps further comprises hook type fasteners positioned adjacent said first end and said second end on said second side of said strap and a loop type fastener positioned between said hook type fasteners on said second side of said strap and a hook type fastener positioned on said first side of said strap wherein said hook type fasteners on said second side of said strap are adapted to form strap loops with said loop type fastener on said second side of said strap; and at least one stop clip secured to one of said sleeves, said stop clip comprising a bracket having a body that defines a passageway, said flexible straps adapted to pass through said passageway.

* * * * *

UNITED STATES PATENT AND TRADEMARK OFFICE

CERTIFICATE OF CORRECTION

PATENT NO. : 6,591,435 B1
DATED : July 15, 2003
INVENTOR(S) : Graham L. Hodgetts It is certified that error appears in the above-identified patent and that said Letters Patent is hereby corrected as shown below:

Title page,
Item [56], References Cited, FOREIGN PATENT DOCUMENTS, insert -- AU 6818 --.

Column 3,
Line 39, “too view” should read -- top view --.

Column 4,
Line 28, “bearing. holder” should read -- bearing holder -- (delete period).

Column 6,
Line 46, “works satisfactory” should read -- works satisfactorily --.

Column 7,
Lines 46-47, “side 85” should read -- side 86 --.
Line 61, “roller 42’.” should read -- roller 42”. --.

Column 14,
Line 34, “33. of the” should read -- 33 of the -- (delete period).

Column 22,
Line 31, “Is defined” should read -- is defined --.

Column 23,
Line 30, “loon fasteners” should read -- loop fasteners --.

Signed and Sealed this

Thirteenth Day of April, 2004

JON W. DUDAS
*Acting Director of the United States Patent and Trademark Office*